US009827782B2

(12) United States Patent
Nishi

(10) Patent No.: US 9,827,782 B2
(45) Date of Patent: Nov. 28, 2017

(54) THERMAL PRINT HEAD AND THERMAL PRINTER

(71) Applicant: ROHM CO., LTD., Kyoto-shi, Kyoto (JP)

(72) Inventor: Koji Nishi, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/112,662

(22) PCT Filed: Jan. 16, 2015

(86) PCT No.: PCT/JP2015/051103

§ 371 (c)(1),
(2) Date: Oct. 7, 2016

(87) PCT Pub. No.: WO2015/111520

PCT Pub. Date: Jul. 30, 2015

(65) Prior Publication Data

US 2017/0120622 A1 May 4, 2017

(30) Foreign Application Priority Data

Jan. 21, 2014 (JP) ..... 2014-008768

(51) Int. Cl.
*B41J 2/335* (2006.01)

(52) U.S. Cl.
CPC ..... *B41J 2/3351* (2013.01); *B41J 2/3354* (2013.01); *B41J 2/33515* (2013.01)

(58) Field of Classification Search
CPC ..... B41J 2/335; B41J 2/33505; B41J 2/3353; B41J 2/33515; B41J 2/3351; B41J 2/3355; B41J 2/33555; B41J 2/3356; B41J 2/33565; B41J 2/3357; B41J 2/33595; B41J 2/34; B41J 2/33525; B41J 2/3352
See application file for complete search history.

(56) References Cited

U.S. PATENT DOCUMENTS

| | | | |
|---|---|---|---|
| 6,812,944 | B2 | 11/2004 | Nakamura |
| 7,692,677 | B2 | 4/2010 | Yamade |
| 8,982,169 | B2 | 3/2015 | Obata et al. |

FOREIGN PATENT DOCUMENTS

| | | | |
|---|---|---|---|
| JP | 6-74338 | I | 10/1994 |
| JP | 7-205465 | A | 8/1995 |
| JP | 11-115232 | A | 4/1999 |
| JP | 11-334126 | A | 12/1999 |

(Continued)

OTHER PUBLICATIONS

International Search Report issued in PCT/JP2015/051103, dated Apr. 14, 2015.

*Primary Examiner* — Kristal Feggins
(74) *Attorney, Agent, or Firm* — Hamre, Schumann, Mueller & Larson, P.C.

(57) ABSTRACT

A thermal print head includes a base member, an electrode layer formed on the base member, and a resistor layer formed on the base member. The electrode layer includes a common electrode and individual electrodes. The resistor layer includes heating units aligned in a main scanning direction. The heating units each include a first heating element and a second heating element spaced apart from each other. The first heating element and the second heating element are electrically connected to the common electrode and one of the individual electrodes to which the first heating element is electrically connected.

42 Claims, 23 Drawing Sheets

(56) References Cited

FOREIGN PATENT DOCUMENTS

| | | | |
|---|---|---|---|
| JP | 2000-25260 | | 1/2000 |
| JP | 2003-266754 | A | 9/2003 |
| JP | 2006-346887 | A | 12/2006 |
| JP | 2010-30144 | A | 2/2010 |
| JP | 2013-173339 | A | 9/2013 |
| JP | 2015-24620 | A | 2/2015 |

THERMAL PRINT HEAD AND THERMAL PRINTER

TECHNICAL FIELD

The present invention relates to a thermal print head and a thermal printer.

BACKGROUND ART

Thermal print heads have been conventionally known (see, for example, PTL 1 below). The thermal print head according to this document includes an insulating substrate, a resistor layer, and an electrode layer. The resistor layer and the electrode layer are formed on the insulating substrate. The resistor layer includes a plurality of heating units, each of which is a part of the resistor layer exposed from the electrode layer. The heating units are aligned in the main scanning direction.

When the thermal print head is put to use, heat from each of the heating unit is transmitted to a printing medium, so that dots are printed on the printing medium. With the conventional thermal print head, gaps may be produced between the dots printed by adjacent heating units.

CITATION LIST

Patent Literature

PTL 1: JP-A-2006-346887

SUMMARY OF INVENTION

Technical Problem

The present invention has been proposed in view of the above circumstances, and it is therefore an object of the invention to provide a thermal print head capable of suppressing appearance of gaps between dots printed on a printing medium.

Solution to Problem

According to a first aspect, there is provided a thermal print head including a base member, an electrode layer formed on the base member, and a resistor layer formed on the base member. The electrode layer includes a common electrode and a plurality of individual electrodes, and the resistor layer includes a plurality of heating units aligned in a main scanning direction. The heating units each include a first heating element and a second heating element spaced apart from each other. The first heating element is electrically connected to the common electrode and one of the individual electrodes, and the second heating element is electrically connected to the common electrode and the one of the individual electrodes to which the first heating element is electrically connected.

Preferably, the first heating element and the second heating element may be electrically connected in parallel.

Preferably, the individual electrodes may be aligned in the main scanning direction and arranged adjacent to one another.

Preferably, a first groove may be formed between the first heating element and the second heating element so as to penetrate through the resistor layer.

Preferably, the first groove may be formed so as to penetrate through a part of the electrode layer.

Preferably, the first groove may be formed so as to penetrate through the common electrode and the individual electrode.

Preferably, the first groove may be formed so as to extend in a sub scanning direction.

Preferably, the first groove may be greater in length in the sub scanning direction than the first heating element.

Preferably, a portion of the first groove penetrating through the common electrode may have a size of 5 to 30 μm in the sub scanning direction.

Preferably, a portion of the first groove penetrating through the individual electrode may have a size of 5 to 30 μm in the sub scanning direction.

Preferably, a second groove may be formed between two of the heating units adjacent to each other so as to penetrate through the resistor layer.

Preferably, the second groove may be formed so as to penetrate through a part of the electrode layer.

Preferably, the second groove may be greater in size in the sub scanning direction than the first groove.

Preferably, the second groove may include a narrowed portion and a widened portion, where the width of the narrowed portion in the main scanning direction may be smaller than the width of the widened portion in the main scanning direction, and the narrowed portion may overlap with the entirety of the first groove in the sub scanning direction.

Preferably, the common electrode may include a common electrode strip-shaped portion extending in the main scanning direction, and the individual electrodes may be opposed to the common electrode strip-shaped portion in sub scanning direction with respect to the heating units.

Preferably, the common electrode may include a plurality of protruding portions each extending from the common electrode strip-shaped portion, and each of the protruding portions may be in contact with one of the heating units.

Preferably, the protruding portions may each include a common electrode base portion, a first common electrode joint portion, and a second common electrode joint portion. The common electrode base portion may extend from the common electrode strip-shaped portion, the first common electrode joint portion and the second common electrode joint portion may be branched from the common electrode base portion, the first common electrode joint portion may be in contact with the first heating element, and the second common electrode joint portion may be in contact with the second heating element.

Preferably, the protruding portions may each include a constricted portion.

Preferably, the individual electrodes may each include an individual electrode base portion, a first individual electrode joint portion, and a second individual electrode joint portion. The first individual electrode joint portion and the second individual electrode joint portion may be branched from the individual electrode base portion, the first individual electrode joint portion may be in contact with the first heating element, and the second individual electrode joint portion may be in contact with the second heating element.

Preferably, the individual electrodes may each include a constricted portion.

Preferably, the resistor layer may be disposed between the base member and the electrode layer.

Preferably, the common electrode and the one of the individual electrodes electrically connected to the first heating element may be spaced apart from each other by a first distance with the first heating element interposed therebetween, and the size of the first heating element in the main scanning direction may be smaller than the first distance.

Preferably, the first distance may be 60 to 100 μm, and the size of the first heating element in the main scanning direction may be 40 to 60 μm.

Preferably, the heating units may each include at least one additional heating element that is spaced apart from both of the first heating element and the second heating element in the main scanning direction, and the resistance of the one additional heating element may be smaller than both the resistance of the first heating element and the resistance of the second heating element.

Preferably, the thermal print head may further include a heat storage region disposed between the base member and the heating units.

Preferably, the thermal print head may further include an auxiliary conductive layer overlapping with the common electrode in plan, where the auxiliary conductive layer is disposed between the electrode layer and the base member.

Preferably, the auxiliary conductive layer may be made of Ag.

Preferably, the auxiliary conductive layer may have a thickness of 10 to 30 μm.

Preferably, the thermal print head may further include a driver IC for supplying a current to the electrode layer.

Preferably, the thermal print head may further include a wire connecting the driver IC and the electrode layer.

Preferably, the thermal print head may further include a resin portion covering the driver IC.

Preferably, the thermal print head may further include a wiring board on which the driver IC is mounted.

Preferably, the thermal print head may further include an insulative protection layer covering the resistor layer and the electrode layer.

Preferably, the base member may be made of a ceramic material.

Preferably, the heat storage region may be made of glass.

Preferably, the electrode layer may be made of Al.

Preferably, the electrode layer may be formed by sputtering.

Preferably, the resistor layer may be made of $TaSiO_2$ or TaN.

Preferably, the resistor layer may have a thickness of 0.05 to 0.2 μm.

Preferably, the resistor layer may be formed by sputtering.

Preferably, the thermal print head may further include a heat dissipation plate supporting the base member.

According to a second aspect, there is provided a thermal printer that includes a thermal print head of the first aspect and a platen roller opposed to the thermal print head.

Other features and advantages of the present invention will become more apparent through detailed description given below with reference to the accompanying drawings.

DESCRIPTION OF EMBODIMENTS

Embodiments of the present invention will be described below with reference to the drawings.

First Embodiment

Referring to FIG. 1 to FIG. 21, a first embodiment of the present invention will be described.

Figure 1:
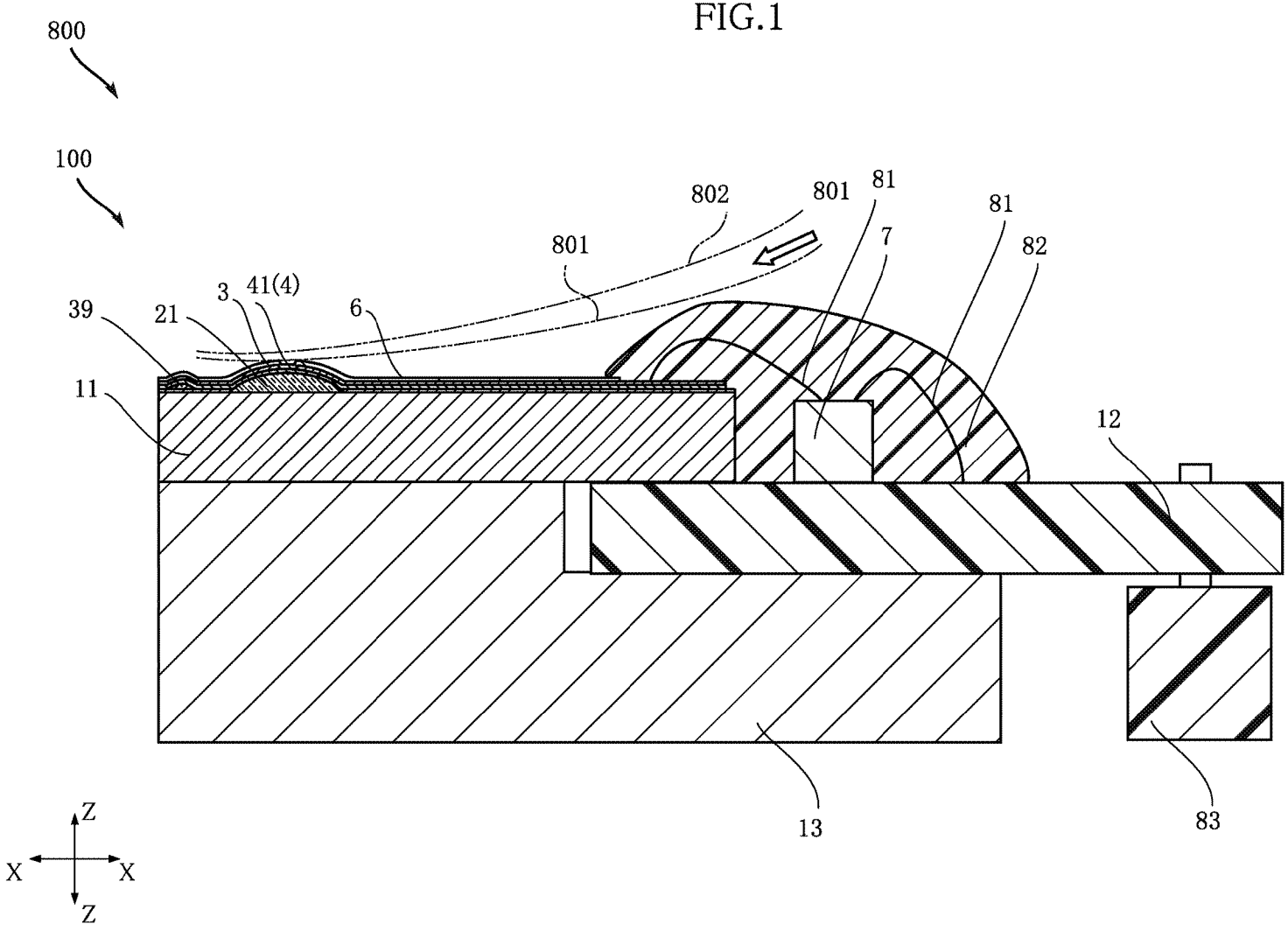
FIG. 1 is a cross-sectional view of a thermal printer according to a first embodiment of the present invention.

FIG. 1 is a cross-sectional view of a thermal printer according to the first embodiment of the present invention.

The thermal printer 800 shown in FIG. 1 is configured to perform printing on a printing medium 801. The printing medium 801 may be thermosensitive paper used for a barcode sheet or a receipt, for example. The thermal printer 800 includes a thermal print head 100 and a platen roller 802 opposed to the thermal print head 100.

Figure 2:
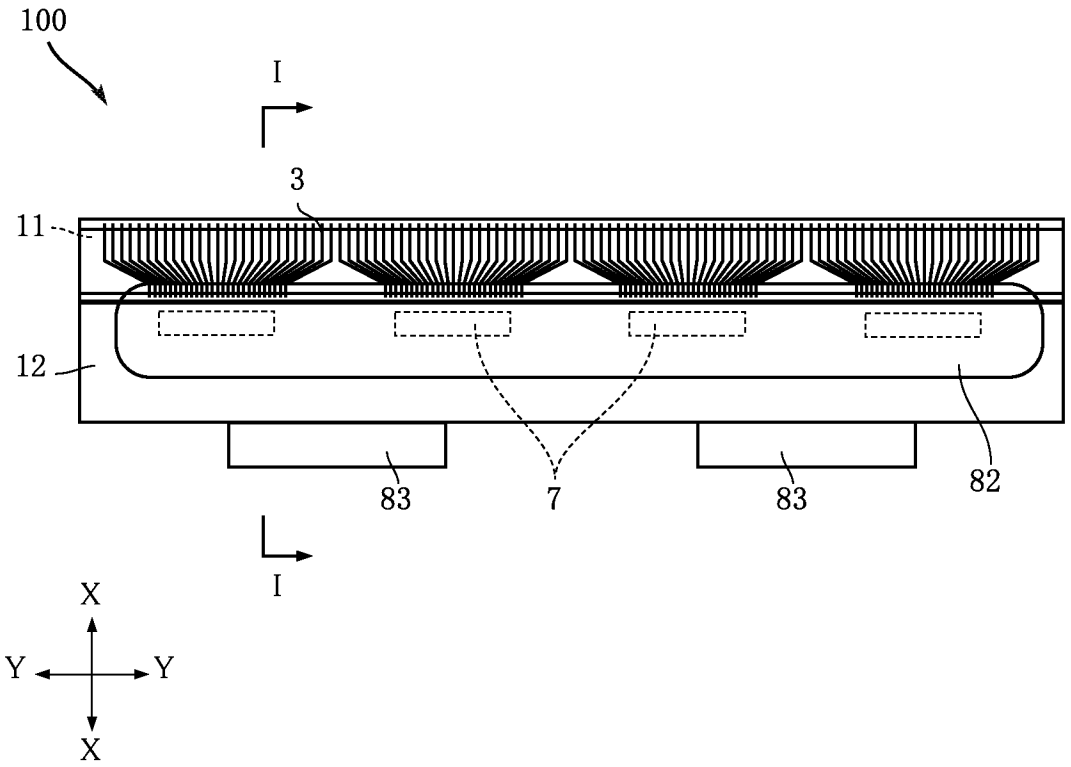
FIG. 2 is a plan view of a thermal print head according to the first embodiment of the present invention.
Figure 3:
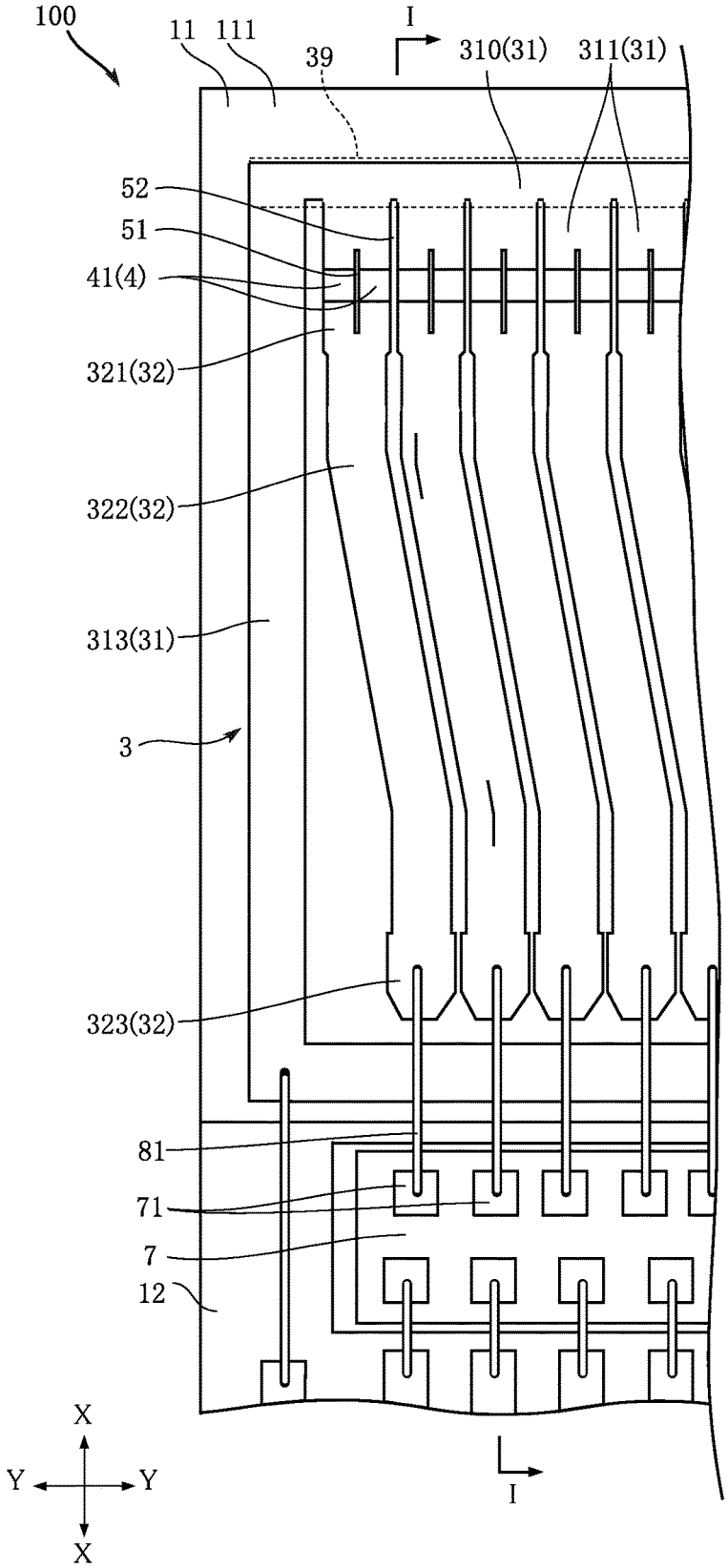
FIG. 3 is an enlarged fragmentary plan view of the thermal print head shown in FIG. 2, with a part omitted.
Figure 4:
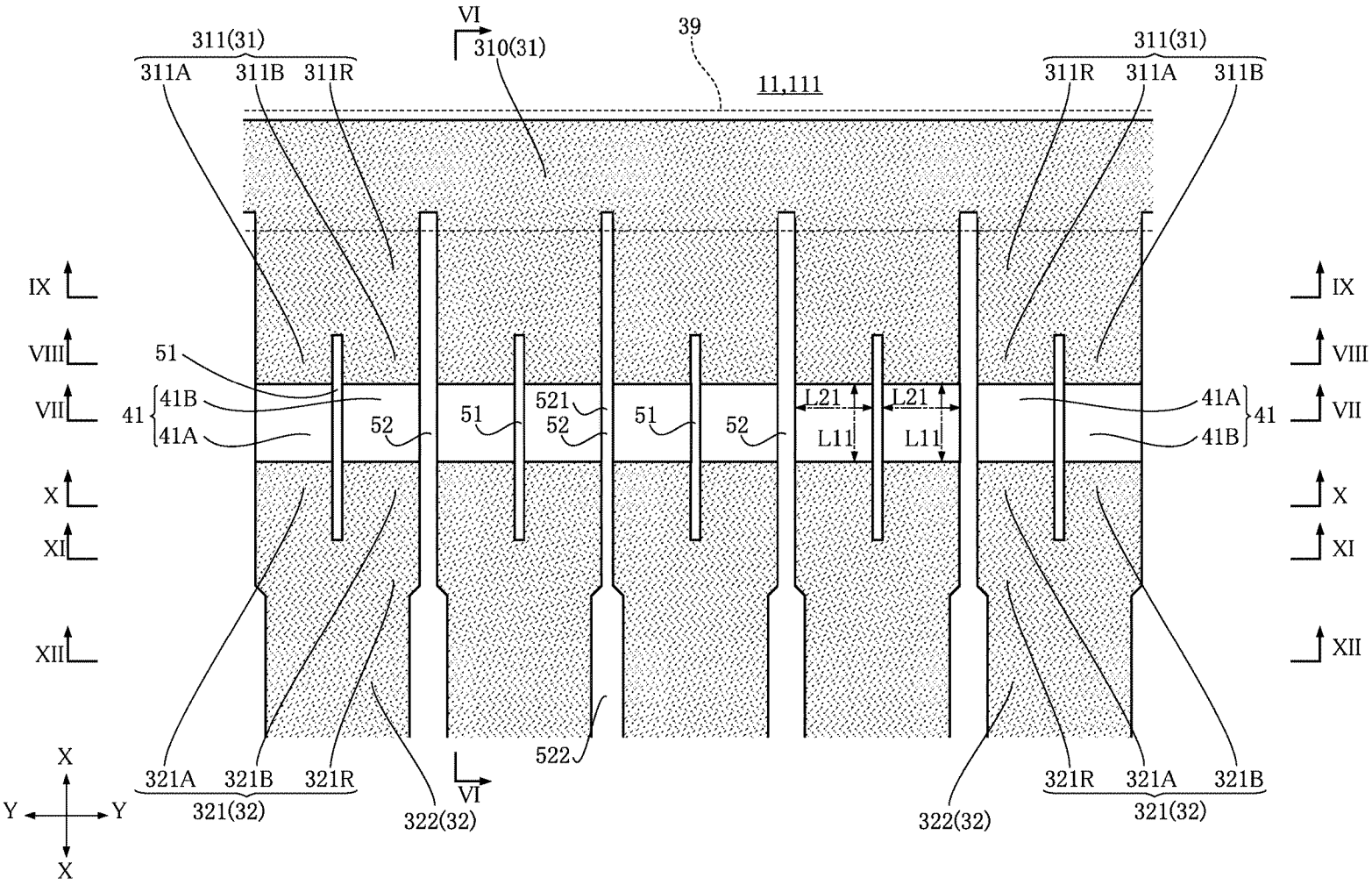
FIG. 4 is an enlarged fragmentary plan view of a part of FIG. 3.
Figure 5:
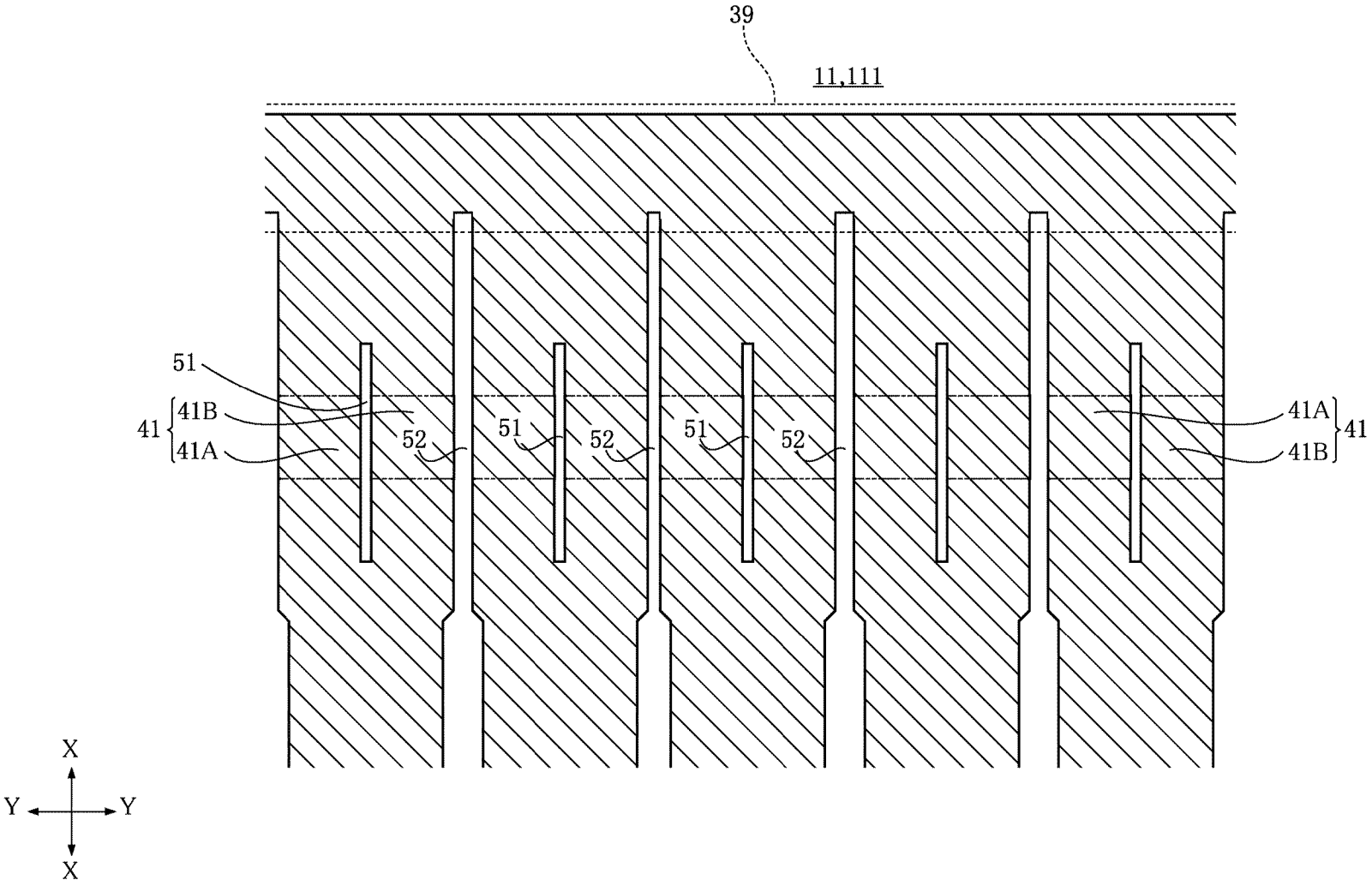
FIG. 5 is a plan view corresponding to FIG. 4, with an electrode layer omitted.
Figure 6:
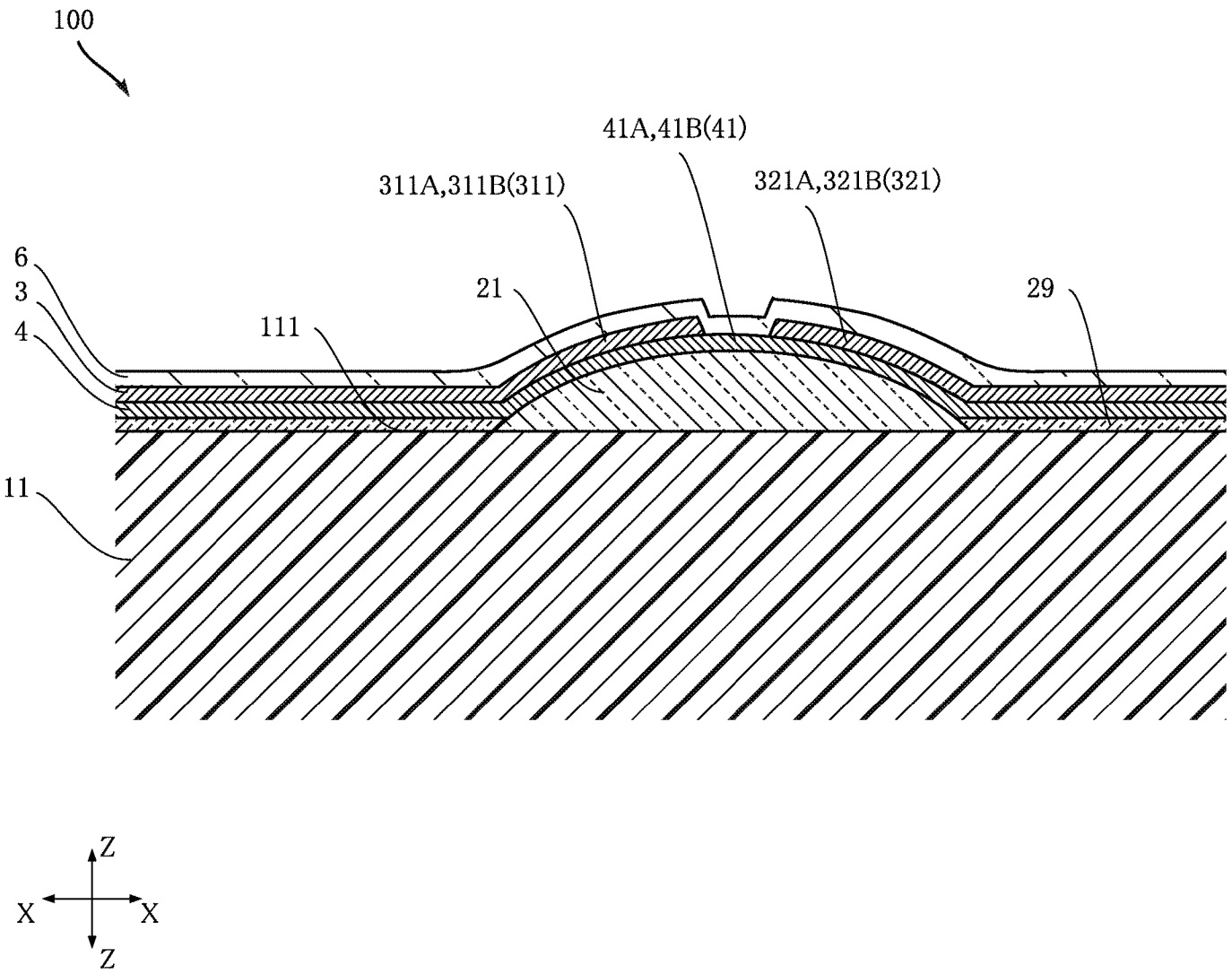
FIG. 6 is a cross-sectional view taken along a line VI-VI in FIG. 4.

FIG. 2 is a plan view of the thermal print head according to the first embodiment of the present invention. FIG. 3 is an enlarged fragmentary plan view of the thermal print head shown in FIG. 2, with a part omitted. FIG. 4 is an enlarged fragmentary plan view of a part of FIG. 3. FIG. 5 is a plan view corresponding to FIG. 4, with an electrode layer omitted. FIG. 6 is a cross-sectional view taken along a line VI-VI in FIG. 4.

The thermal print head 100 shown in the drawings includes a base member 11, a wiring board 12, a heat dissipation plate 13, a heat storage region 21, an electrode layer 3, a resistor layer 4, a protection layer 6, a driver IC7, a plurality of wires 81, a resin portion 82, and a connector 83. For the sake of clarity, the protection layer 6 is omitted in FIG. 2, and the protection layer 6 and the resin portion 82 are omitted in FIG. 3.

The base member 11 shown in FIG. 1, FIG. 2, and FIG. 6 is, for example, made of a ceramic material. Examples of the ceramic material suitable for forming the base member 11 may be alumina or aluminum nitride. The base member 11 has a thickness of, for example, approximately 0.6 to 1.0 mm. As shown in FIG. 2, the base member 11 has an elongate flat plate shape extending in the main scanning direction Y.

As shown in FIG. 3 and FIG. 6, the base member 11 includes a base member surface 111.

The surface 111 is a flat plane extending in the sub scanning direction X and the main scanning direction Y. The surface 111 has longitudinal sides extending in the main scanning direction Y. The surface 111 faces in one side of the thickness direction Z of the base member 11 (upward in FIG. 6).

The wiring board 12 shown in FIG. 1, FIG. 2 is for example a printed circuit board. The wiring board 12 includes a base layer and a non-illustrated wiring layer formed on the base layer. The base layer is, for example, made of a glass epoxy resin. The wiring layer is made of Cu, for example.

The heat dissipation plate 13 shown in FIG. 1 serves to release heat transmitted from the base member 11. The heat dissipation plate 13 is made of a metal, for example Al. The heat dissipation plate 13 supports the base member 11 and the wiring board 12.

As shown in FIG. 6, the heat storage region 21 is formed on the base member 11. The heat storage region 21 is formed on the surface 111 of the base member 11. The heat storage region 21 may also be referred to as glazed layer. In this embodiment, a portion of the heat storage region 21 is elevated upward as shown in FIG. 6. Accordingly, the heat storage region 21 allows a portion of the protection layer 6 covering a heating unit 41 (described later) to come into proper contact with the printing medium 801. The heat storage region 21 is, for example, made of a glass material such as amorphous glass. The softening point of the glass material is, for example, 800 to 850° C. In addition, a glass layer 29 is formed on the right of the heat storage region 21, as shown in FIG. 6. The heat storage region may be formed all over the surface 111, unlike in this embodiment.

The resistor layer 4, for example shown in FIG. 3 and FIG. 6, generates heat at a portion to which a current from the electrode layer 3 is supplied. With the heat thus generated, printing dots are formed. The resistor layer 4 is made of a material having higher resistance than a material forming the electrode layer 3. Examples of the material to form the resistor layer 4 may be $TaSiO_2$ or TaN. In this embodiment the resistor layer 4 is a thick film having a thickness of approximately 0.05 to 0.2 μm. In this embodiment, the resistor layer 4 is disposed between the electrode layer 3 and the base member 11. More specifically, the resistor layer 4 is disposed between the electrode layer 3 and the surface 111 of the base member 11.

As shown in FIG. 4 and FIG. 5 (corresponding to FIG. 4 but without the electrode layer 3), the resistor layer 4 includes a plurality of heating units 41.

The heating units 41 are aligned in the main scanning direction Y. The heating units 41 are stacked on the heat storage region 21. As shown in FIG. 6, the heat storage region 21 is disposed between the heating units 41 and the surface 111. The heating units 41 are each formed so as to span over a portion of the electrode layer 3 where a gap is made.

The heating units 41 each include a first heating element 41A and a second heating element 41B spaced apart from each other. The first heating element 41A is electrically connected to a common electrode 31 (described later) and one of individual electrodes 32 (described later). The second heating element 41B is electrically connected to the common electrode 31 and the one of the individual electrodes 32 electrically connected to the first heating element 41A. The first heating element 41A and the second heating element 41B are electrically connected in parallel. In this embodiment, the first heating element 41A and the second heating element 41B have relatively low resistance.

The electrode layer 3, for example shown in FIG. 4 and FIG. 6, constitutes a path for electrical connection to the resistor layer 4. The electrode layer 3 is made of a conductive material. The conductive material may typically be Al, though use may be made of Cu or Au instead. The electrode layer 3 is stacked on the surface 111. The electrode layer 3 is stacked on the heat storage region 21. In this embodiment, the electrode layer 3 is stacked on the resistor layer 4. In FIG. 4, the electrode layer 3 is shaded for the sake of clarity.

As shown in FIG. 3 and FIG. 4, the electrode layer 3 includes one common electrode 31 and a plurality of individual electrodes 32 (FIG. 3 and FIG. 4 illustrate five of those) in this embodiment. Further details will be described below.

The common electrode 31 assumes an electrically reverse polarity to the individual electrodes 32, when the thermal printer 800, with the thermal print head 100 incorporated therein, is put to use.

The common electrode 31 includes a strip-shaped portion 310, a plurality of protruding portions 311, and a circumventing portion 313.

The strip-shaped portion 310 is located close to an edge of the base member 11 in the sub scanning direction X, and formed in a strip shape extending in the main scanning direction Y.

The protruding portions 311 each extend from the strip-shaped portion 310. More specifically, the protruding portions 311 each extend from the strip-shaped portion 310 in the sub scanning direction X. The protruding portions 311 are each in contact with one of the heating units 41.

As shown in FIG. 4, the protruding portions 311 each include a base portion 311R, a first joint portion 311A, and a second joint portion 311B.

The base portion 311R continuously extends from the strip-shaped portion 310. The first joint portion 311A and the second joint portion 311B are branched from the base portion 311R. The first joint portion 311A is in contact with the first heating element 41A, and the second joint portion 311B is in contact with the second heating element 41B. The first joint portion 311A and the second joint portion 311B are spaced apart from each other in the main scanning direction Y.

The circumventing portion 313 shown in FIG. 3 extends in the sub scanning direction X, from an end portion of the strip-shaped portion 310 in the main scanning direction Y.

The individual electrodes 32 shown in FIG. 3 and FIG. 4 are not electrically connected to one another. Accordingly, a different potential can be individually applied to each of the individual electrodes 32, when the thermal printer 800, with the thermal print head 100 incorporated therein, is put to use. The individual electrodes 32 are aligned in the main scanning direction Y and arranged adjacent to one another. The individual electrodes 32 are opposed to the strip-shaped portion 310 in the sub scanning direction X across the heating units 41.

The individual electrodes 32 each include a joint portion 321, a strip-shaped portion 322, and a bonding portion 323.

The joint portion 321 is connected to one of the heating units 41.

The joint portion 321 includes a base portion 321R, a first joint portion 321A, and a second joint portion 321B.

The first joint portion 321A and the second joint portion 321B are branched from the base portion 321R. The first joint portion 321A is in contact with the first heating element 41A, and the second joint portion 321B is in contact with the second heating element 41B. The first joint portion 321A and the second joint portion 321B are spaced apart from each other in the main scanning direction Y.

As shown in FIG. 4, the common electrode 31 and one of the individual electrodes 32 that is electrically connected to the first heating element 41A are spaced apart from each other by a first distance L11, with the first heating element 41A interposed therebetween. Likewise, the common electrode 31 and one of the individual electrodes 32 that is electrically connected to the second heating element 41B are spaced apart from each other by the first distance L11, with the second heating element 41B interposed therebetween. In this embodiment, the first distance L11 accords with the spacing between the first joint portion 311A and the first joint portion 321A, as well as the spacing between the second joint portion 311B and the second joint portion 321B. In this embodiment, a size L21 of the first heating element 41A in the main scanning direction Y is smaller than the first distance L11. The first distance L11 is, for example, 60 to 100 μm, and the size L21 of the first heating element 41A in the main scanning direction Y is, for example, 40 to 60 μm.

The strip-shaped portion 322 continuously extends in a strip shape from the joint portion 321. The bonding portion 323, continuously extending from the joint portion 321, is the region where the wire 81 is bonded.

As shown in FIG. 1, FIG. 3, and FIG. 4, in this embodiment an auxiliary conductive layer 39 is formed so as to overlap with the common electrode 31 in plan. The auxiliary conductive layer 39 is disposed between the electrode layer 3 and the base member 11. The auxiliary conductive layer 39 is made of Ag. The auxiliary conductive layer 39 has a thickness of, for example, 10 to 30 μm. Here, the auxiliary conductive layer 39 may be excluded from the thermal print head 100.

Figure 7:
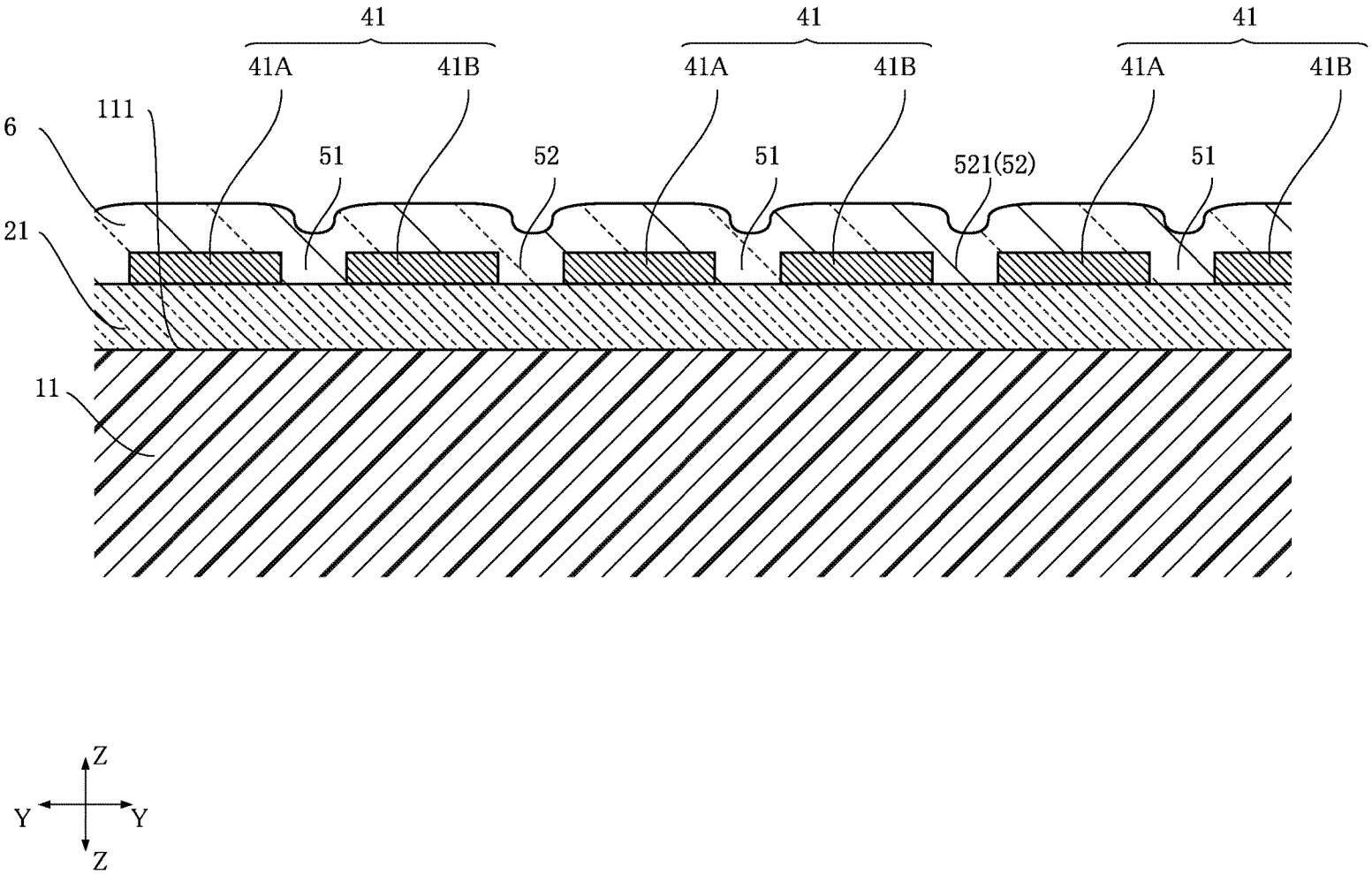
FIG. 7 is a cross-sectional view taken along a line VII-VII in FIG. 4.
Figure 8:
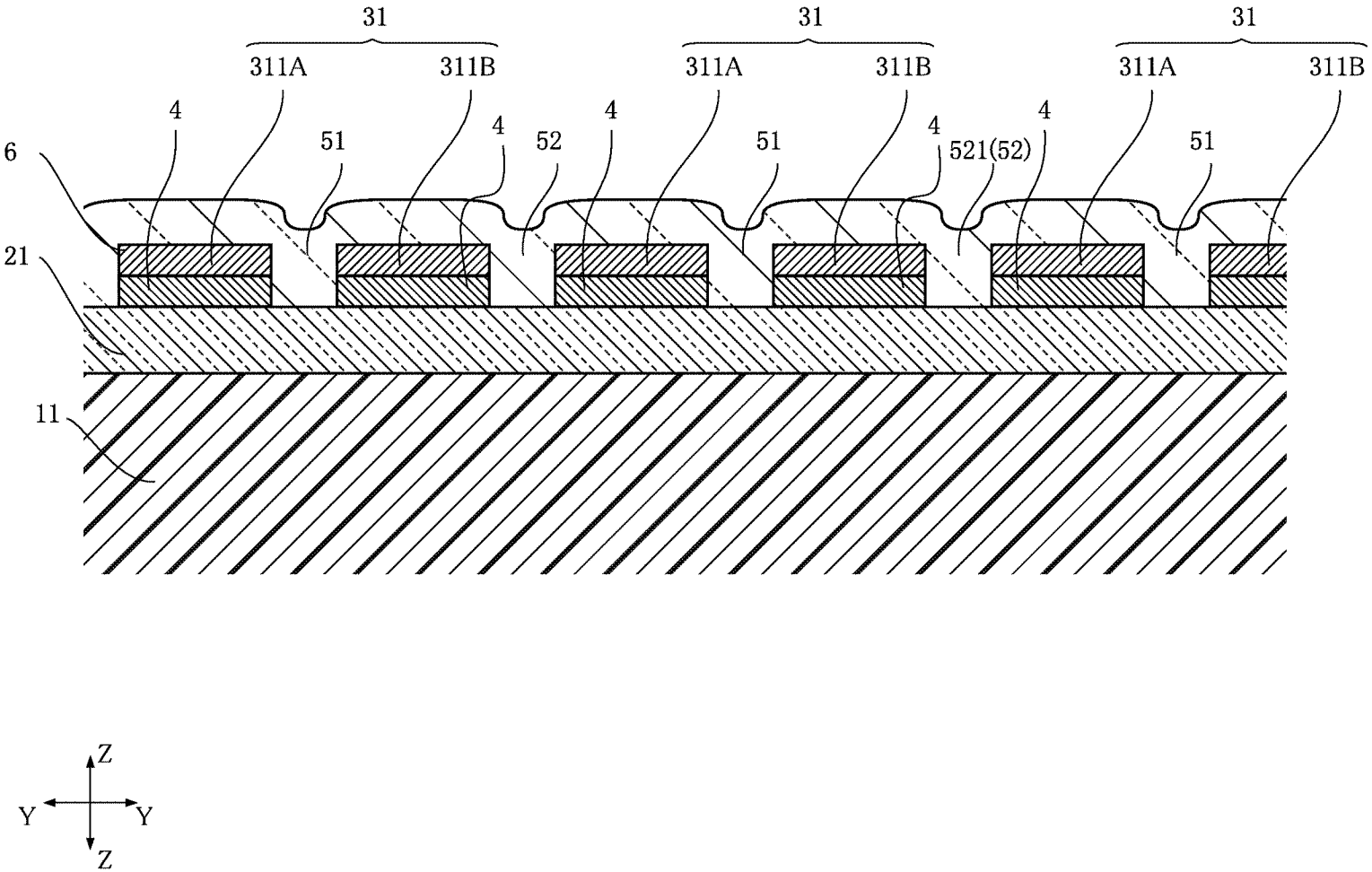
FIG. 8 is a cross-sectional view taken along a line VIII-VIII in FIG. 4.
Figure 9:
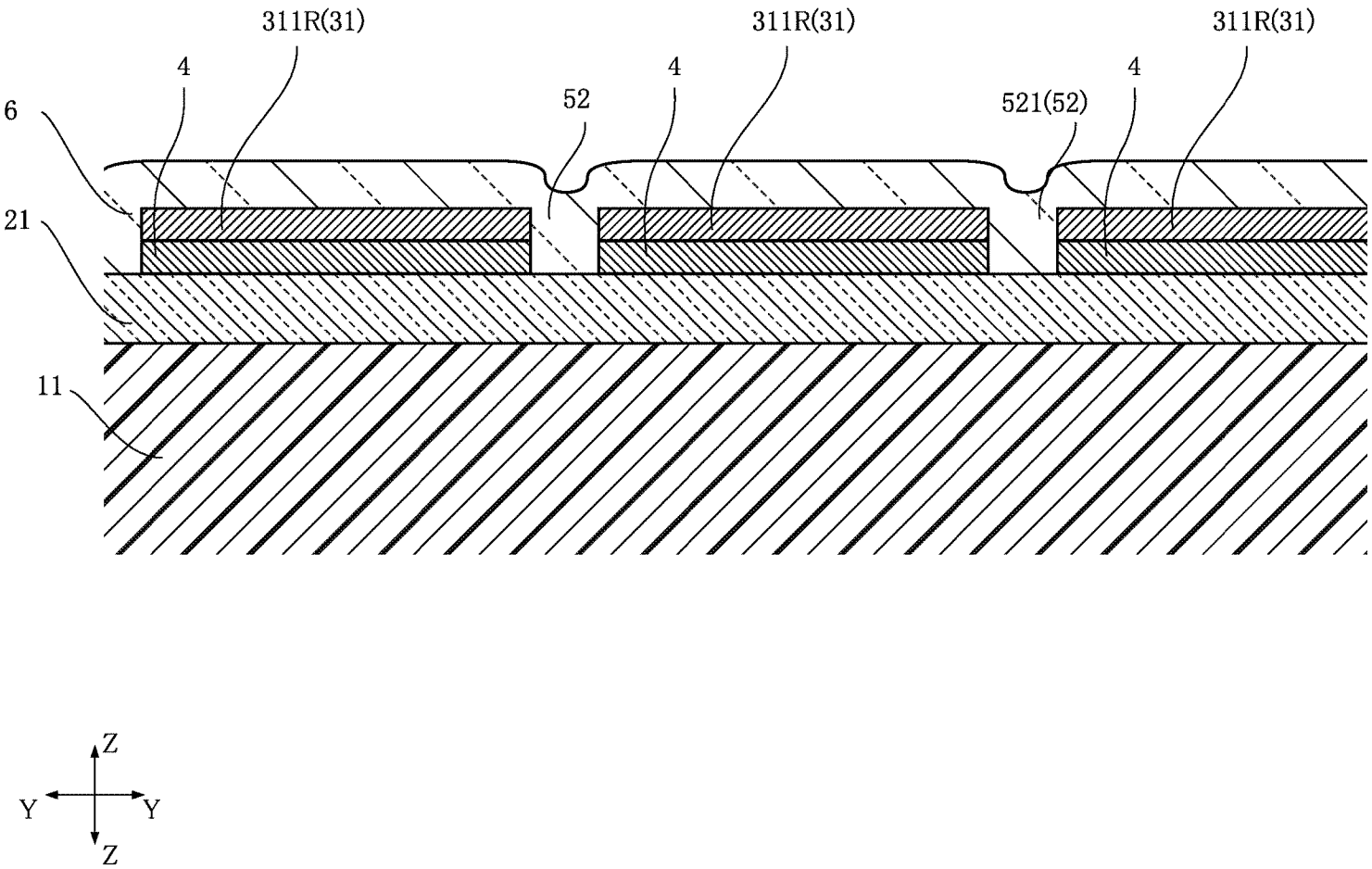
FIG. 9 is a cross-sectional view taken along a line IX-IX in FIG. 4.
Figure 10:
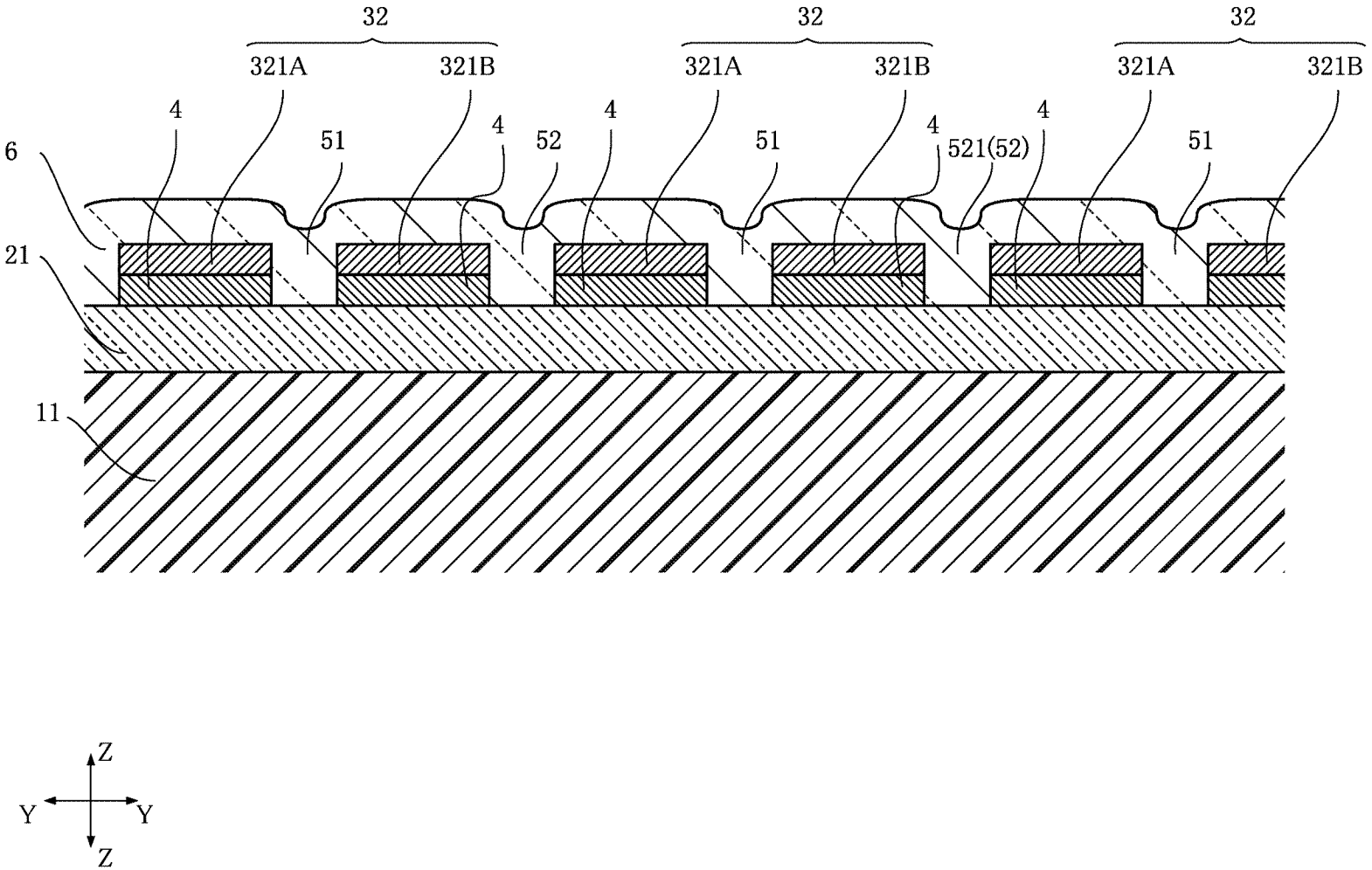
FIG. 10 is a cross-sectional view taken along a line X-X in FIG. 4.
Figure 11:
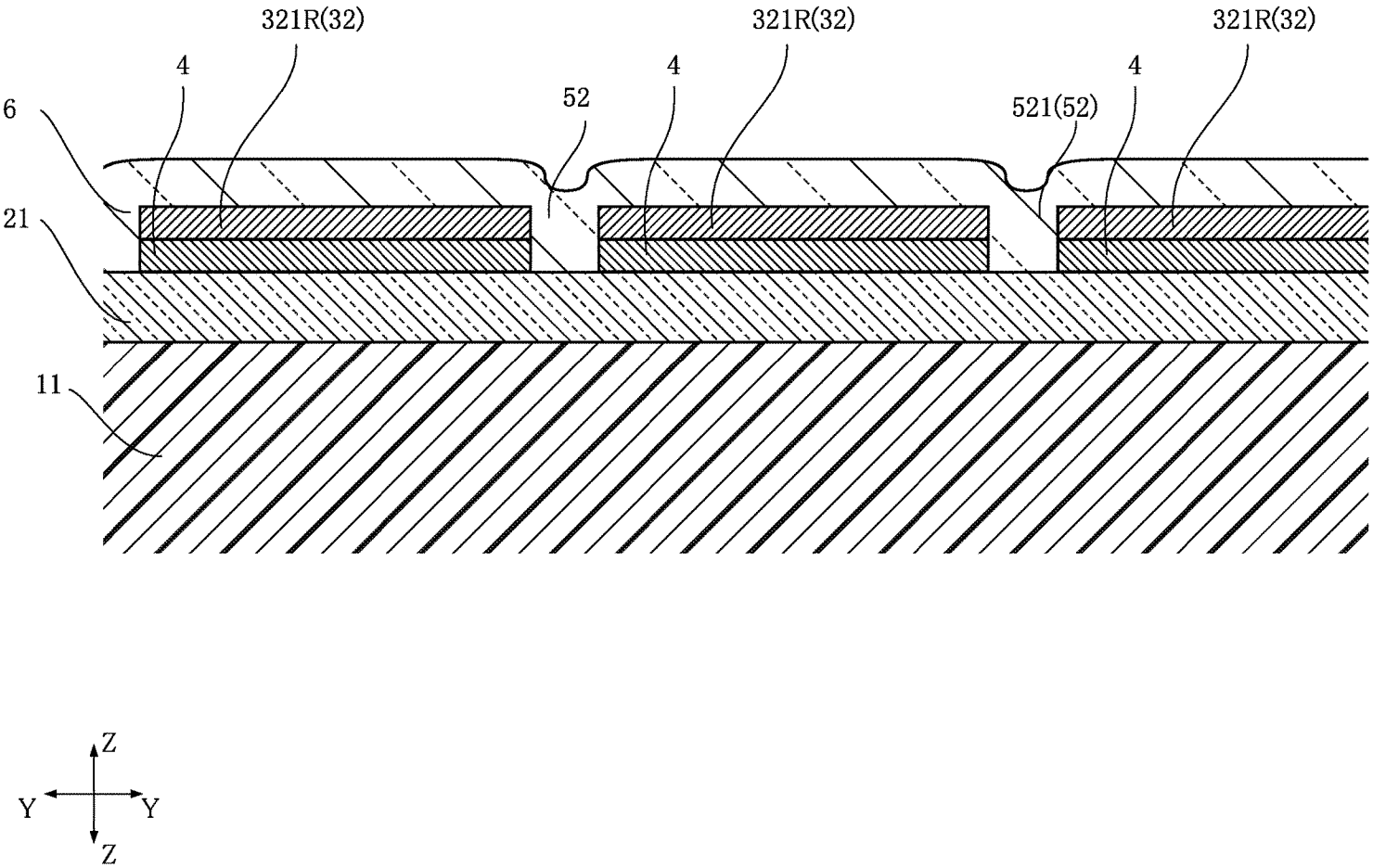
FIG. 11 is a cross-sectional view taken along a line XI-XI in FIG. 4.
Figure 12:
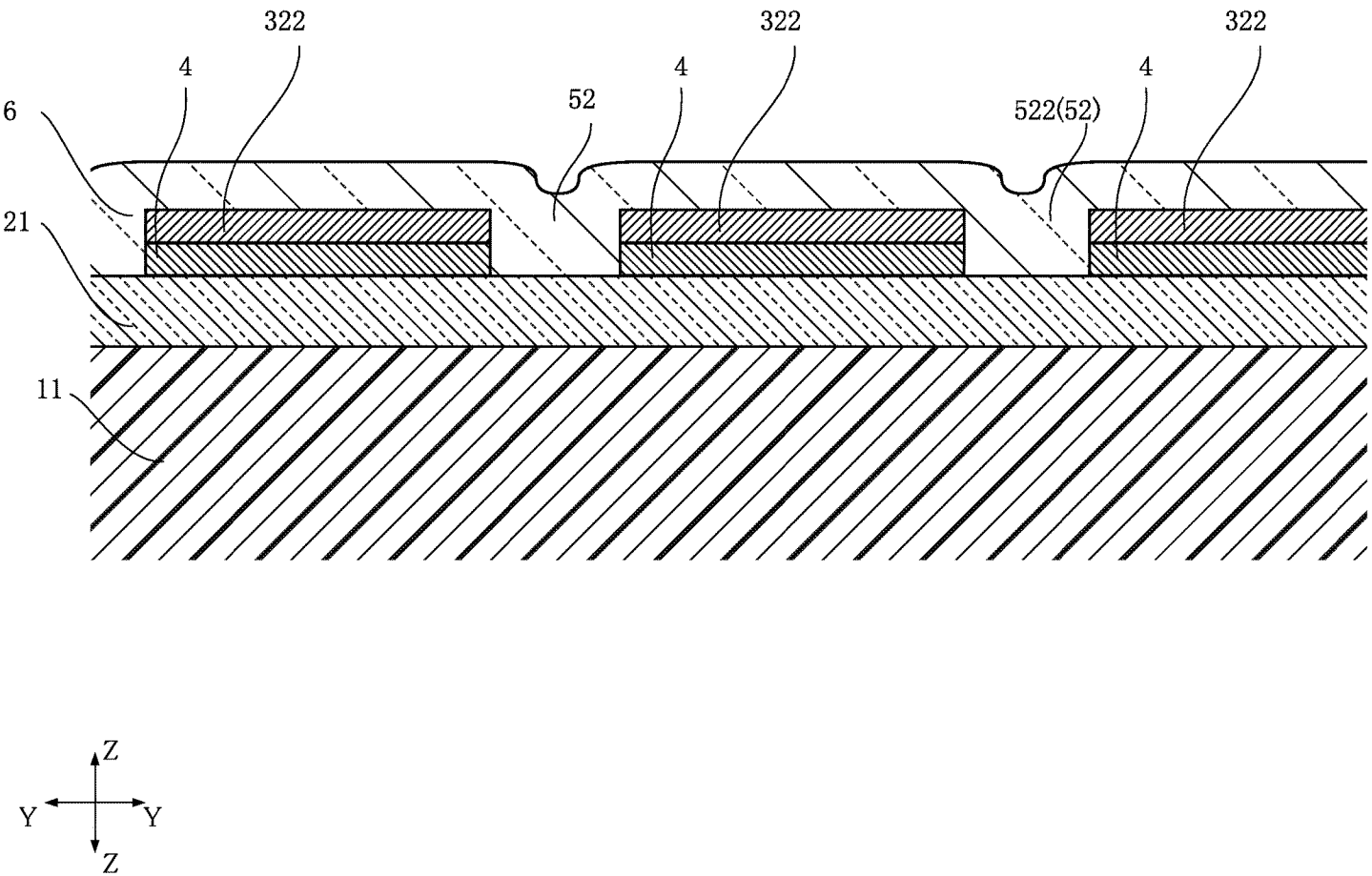
FIG. 12 is a cross-sectional view taken along a line XII-XII in FIG. 4.

FIG. 7 is a cross-sectional view taken along a line VII-VII in FIG. 4. FIG. 8 is a cross-sectional view taken along a line VIII-VIII in FIG. 4. FIG. 9 is a cross-sectional view taken along a line IX-IX in FIG. 4. FIG. 10 is a cross-sectional view taken along a line X-X in FIG. 4. FIG. 11 is a cross-sectional view taken along a line XI-XI in FIG. 4. FIG. 12 is a cross-sectional view taken along a line XII-XII in FIG. 4.

As shown in FIG. 3 to FIG. 12, first grooves 51 and second grooves 52 are formed in this embodiment.

The first groove 51 is formed between the first heating element 41A and the second heating element 41B, so as to penetrate through the resistor layer 4. The first groove 51 is formed so as to penetrate through a part of the electrode layer 3. The first groove 51 is formed so as to penetrate through the common electrode 31 and the individual electrode 32. The first groove 51 is elongate in the sub scanning direction X. The first groove 51 is longer in the sub scanning direction X than is the first heating element 41A. A portion of the first groove 51 penetrating through the common electrode 31 has a size of 5 to 30 μm in the sub scanning direction X. In other words, in the common electrode 31 the first joint portion 311A and the second joint portion 311B are spaced apart from each other with the first groove 51 interposed therebetween. In the individual electrode 32, likewise, the first joint portion 321A and the second joint portion 321B are spaced apart from each other with the first groove 51 interposed therebetween. In addition, a portion of the first groove 51 penetrating through the individual electrode 32 has a size of 5 to 30 μm in the sub scanning direction X.

The second groove 52 is formed between two of the heating units 41 adjacent to each other, so as to penetrate through the resistor layer 4. The second groove 52 is formed so as to penetrate through a part of the electrode layer 3. The second groove 52 is longer in the sub scanning direction X than is the first groove 51.

As shown in FIG. 4, the second groove 52 includes a narrowed portion 521 and a widened portion 522. The narrowed portion 521 is narrower in the main scanning direction Y than is the widened portion 522, and the narrowed portion 521 overlaps with the entirety of the first groove 51 in the sub scanning direction X.

The protection layer 6 shown in FIG. 6 to FIG. 12 covering the electrode layer 3 and the resistor layer 4 serves to protect the electrode layer 3 and the resistor layer 4. The protection layer 6 is made of an insulative material, for example $SiO_2$. The electrode layer 3 is disposed between the protection layer 6 and the resistor layer 4. In this embodiment, a part of the protection layer 6 is formed over the first groove 51 and the second groove 52.

The driver IC7 shown in FIG. 1 to FIG. 3 serves to apply a potential to each of the individual electrodes 32 and control a current to be supplied to each of the heating units 41. When a potential is applied to each of the individual electrodes 32 a voltage is applied between the common electrode 31 and each of the individual electrodes 32, so that a current is selectively supplied to each of the heating units 41. The driver IC7 is mounted on the wiring board 12. As shown in FIG. 3, the driver IC7 includes a plurality of pads 71. The pads 71 are, for example, aligned in two rows. Here, the driver IC7 may be mounted on the base member 11 unlike in this embodiment.

The wires 81 shown in FIG. 1 and FIG. 3 are made of a conductive material such as Au. One of the wires 81 is bonded to one of the pads 71 of the driver IC7, and to the bonding portion 323. Thus, the driver IC7 and each of the individual electrodes 32 are electrically connected to each other. As shown in FIG. 3, another wire 81 is bonded to another pad 71 of the driver IC7, and to the wiring layer of the wiring board 12. Thus, the driver IC7 and the connector 83 are electrically connected to each other via the wiring layer. As shown in FIG. 3, in addition, another wire 81 is bonded to the common electrode 31 and to the wiring layer of the wiring board 12. Thus, the common electrode 31 and the wiring layer are electrically connected to each other.

The resin portion 82 shown in FIG. 1 and FIG. 2 is, for example, made of a black resin. The resin portion 82 covers the driver IC7, the wires 81, and the protection layer 6, thereby protecting the driver IC7 and the wires 81. The connector 83 is fixed to the wiring board 12. The connector 83 serves to supply power from outside the thermal print head 100 to the thermal print head 100, or to control the driver IC7.

An example of how to use the thermal print head 100 will be briefly described.

The thermal print head 100 is incorporated in the thermal printer 800 to perform its function. As shown in FIG. 1, the heating units 41 of the thermal print head 100 are opposed to the platen roller 802, in the thermal printer 800. When the thermal printer 800 is put to use, the platen roller 802 is rotated so as to feed the printing medium 801 in the sub scanning direction X into between the platen roller 802 and the heating units 41, at a constant speed. The printing medium 801 is pressed by the platen roller 802 against a portion of the protection layer 6 covering the heating units 41. At the same time, the driver IC7 selectively applies a potential to each of the individual electrodes 32. Accordingly, a voltage is applied between the common electrode 31 and each of the individual electrodes 32, so that a current selectively runs through each of the heating units 41 thereby generating heat. The heat thus generated in the heating unit 41 is transmitted to the printing medium 801 through the protection layer 6. As a result, a plurality of dots are printed on a first line region of the printing medium 801 linearly extending in the main scanning direction Y. The heat generated in the heating unit 41 is also transmitted to the heat storage region 21, to be stored therein.

When the platen roller 802 is rotated further, the printing medium 801 is further transported in the sub scanning direction X at a constant speed. Then dots are printed, as on the first line region, on a second line region of the printing medium 801 linearly extending in the main scanning direction Y and adjacent to the first line region. When the printing is performed on the second line region, the heat stored in the heat storage region 21 when the printing was performed on the first line region is transmitted to the printing medium 801, in addition to the heat generated in the heating unit 41. Thus, the printing on the second line region is performed. The printing on the printing medium 801 is performed by thus sequentially printing the dots on each of the line regions of the printing medium 801 extending in the main scanning direction Y.

Referring now to FIG. 13 to FIG. 21, a manufacturing method of the thermal print head 100 will be described below.

Figure 13:
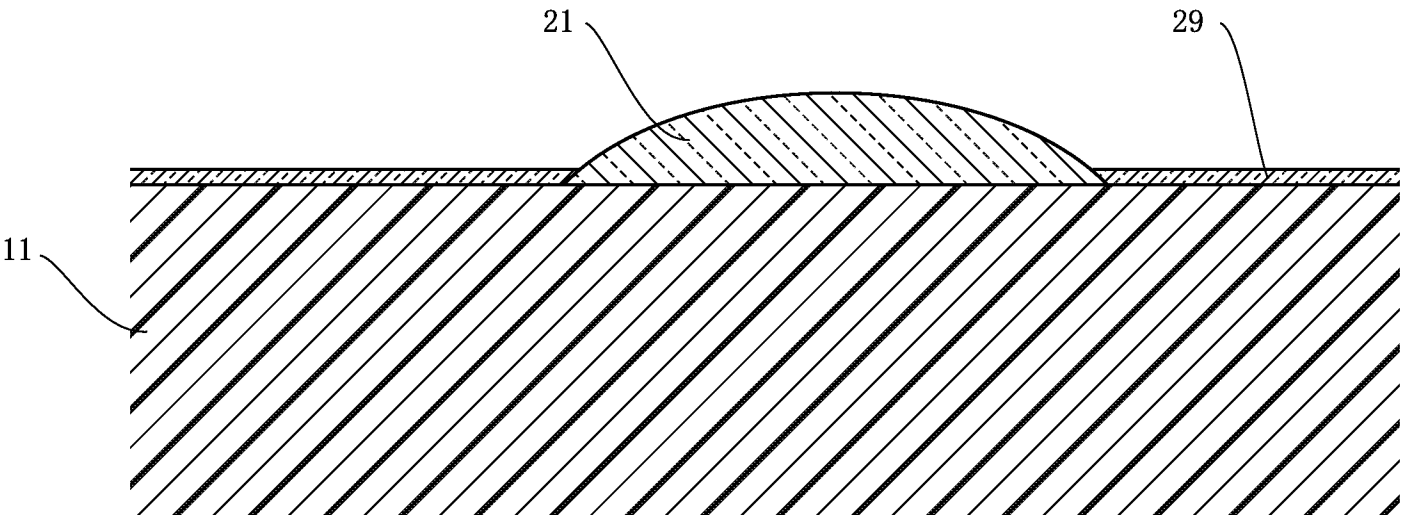
FIG. 13 is a cross-sectional view for explaining a manufacturing process of the thermal print head according to the first embodiment of the present invention.

First, the base member 11 shown in FIG. 13 is prepared. Then the heat storage region 21 is formed on the base member 11. The heat storage region 21 may be formed, for example, through thickly printing a paste containing glass on the base member 11 and sintering the printed paste. The sintering temperature of the paste is, for example, 800 to 850° C. In this embodiment, the glass layer 29 is formed following the formation of the heat storage region 21. Although not illustrated, the auxiliary conductive layer 39 shown in FIG. 1 is then formed on the base member 11. The auxiliary conductive layer 39 is made of Ag.

Figure 14:
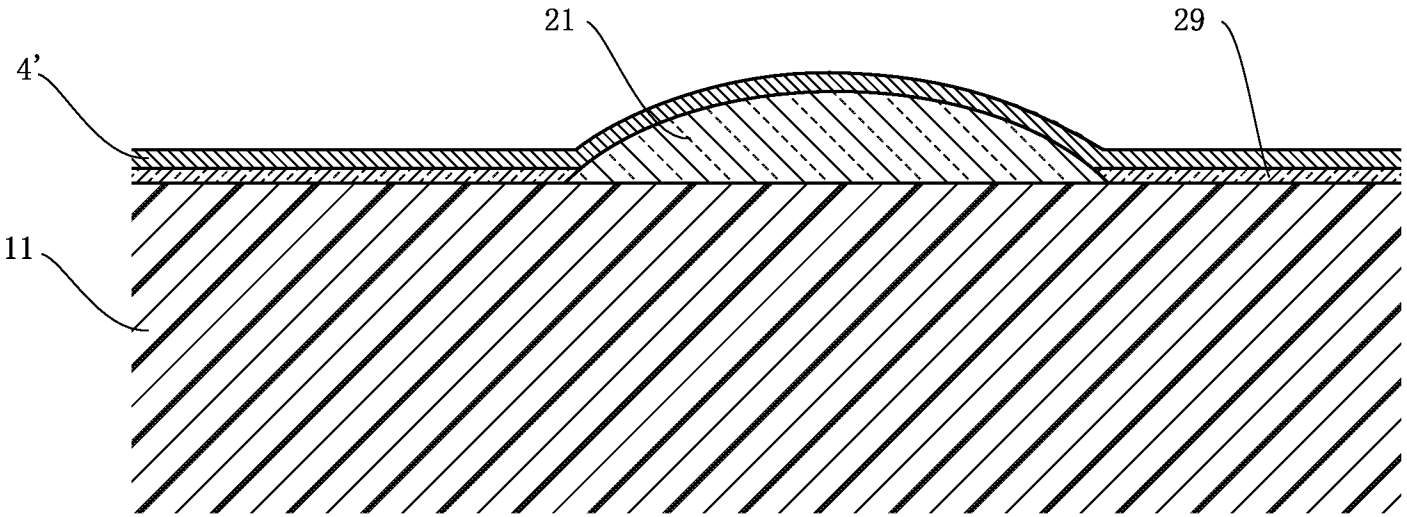
FIG. 14 is a cross-sectional view for explaining a manufacturing process that follows the process of FIG. 13.

Referring to FIG. 14, a resistor layer 4' is formed. The resistor layer 4' is formed all over the surface 111 of the base member 11. The resistor layer 4' may be formed, for example, by depositing $TaSiO_2$ or TaN by sputtering.

Figure 15:
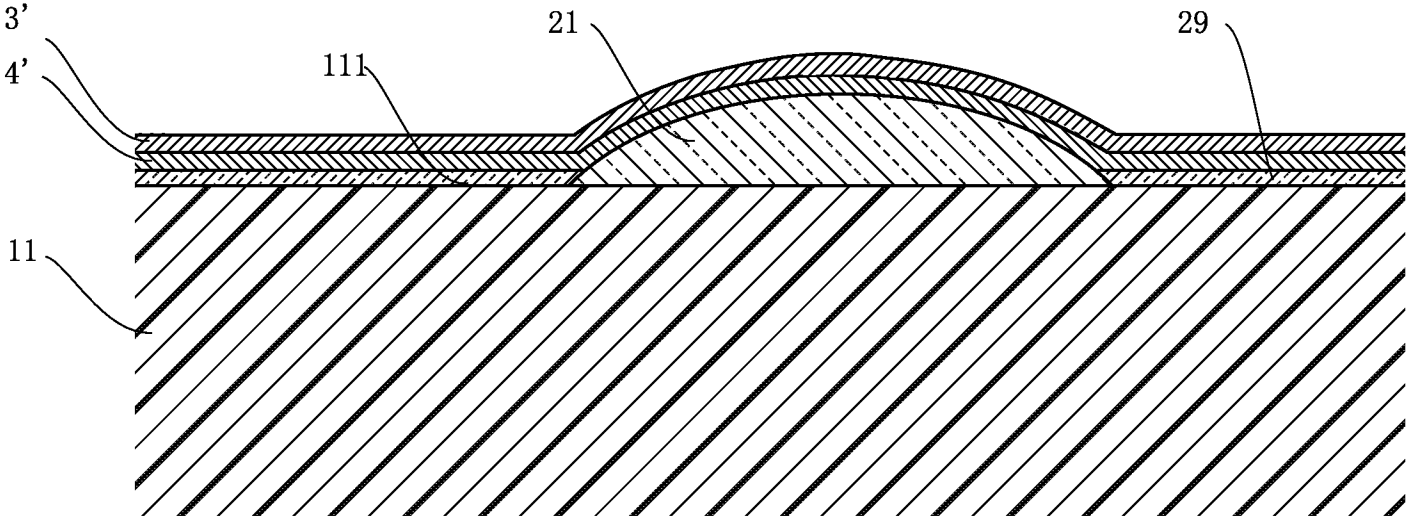
FIG. 15 is a cross-sectional view for explaining a manufacturing process that follows the process of FIG. 14.
Figure 16:
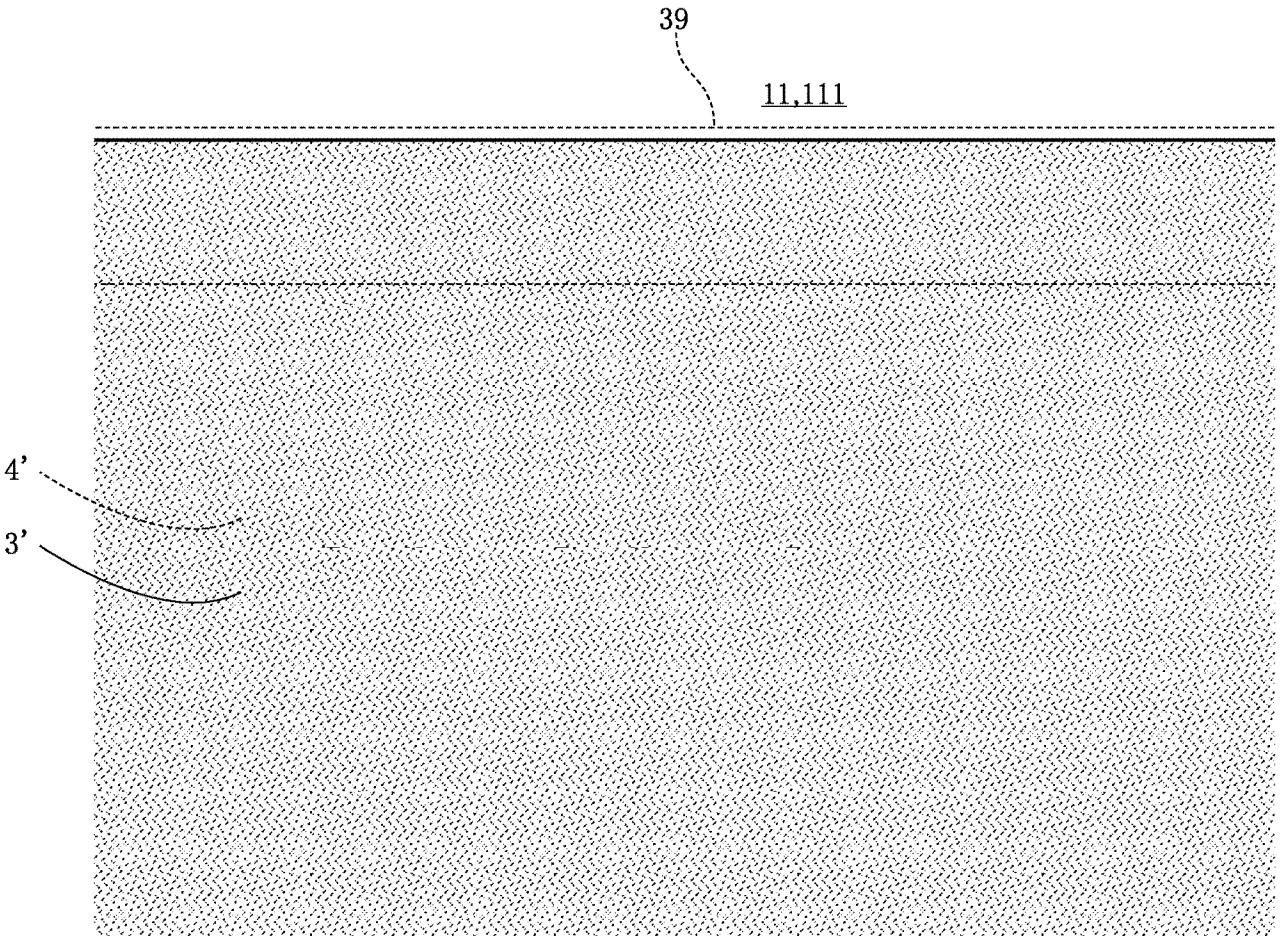
FIG. 16 is a plan view showing a state obtained upon performing the process of FIG. 15.

Referring to FIG. 15 and FIG. 16, an electrode layer 3' is formed on the resistor layer 4'. The electrode layer 3' is formed all over the surface 111 of the base member 11. The electrode layer 3' may be formed, for example, by depositing a conductive material by sputtering.

Figure 17:
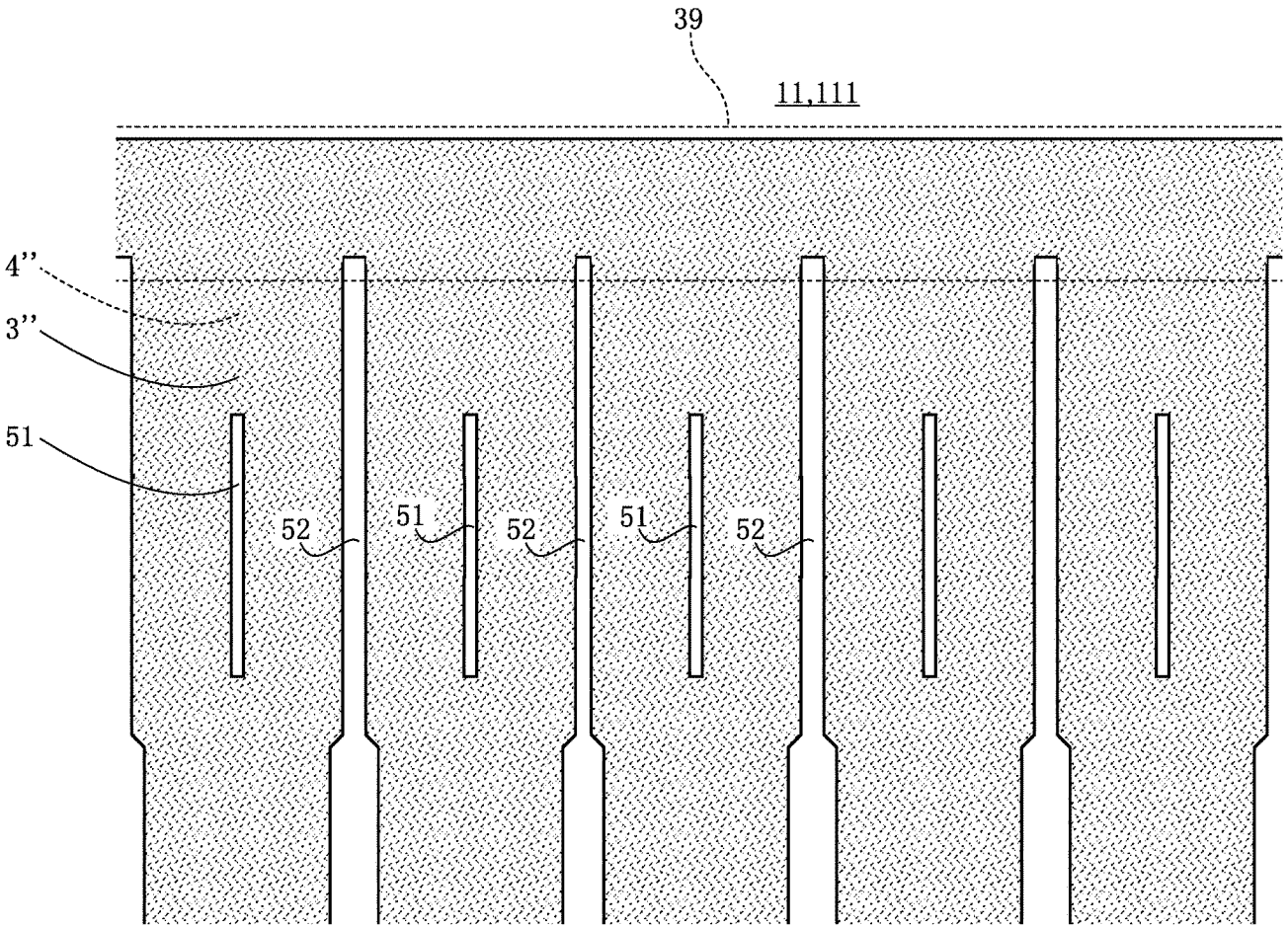
FIG. 17 is a cross-sectional view for explaining a manufacturing process that follows the process of FIG. 16.

Proceeding to FIG. 17, an etching process is performed over the electrode layer 3' and the resistor layer 4', so as to form an electrode layer 3" and a resistor layer 4". Through this process, the first groove 51 and the second groove 52 are formed in the electrode layer 3" and the resistor layer 4".

Figure 18:
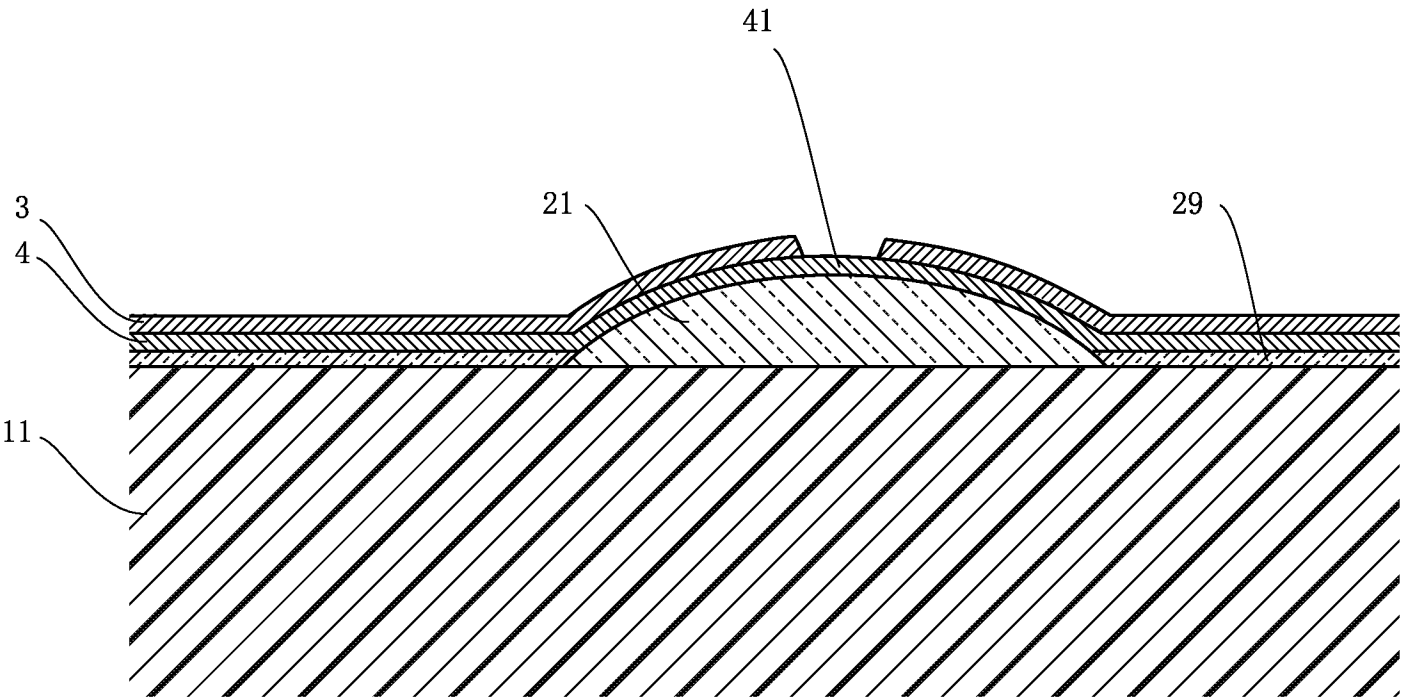
FIG. 18 is a cross-sectional view for explaining a manufacturing process that follows the process of FIG. 17.
Figure 19:
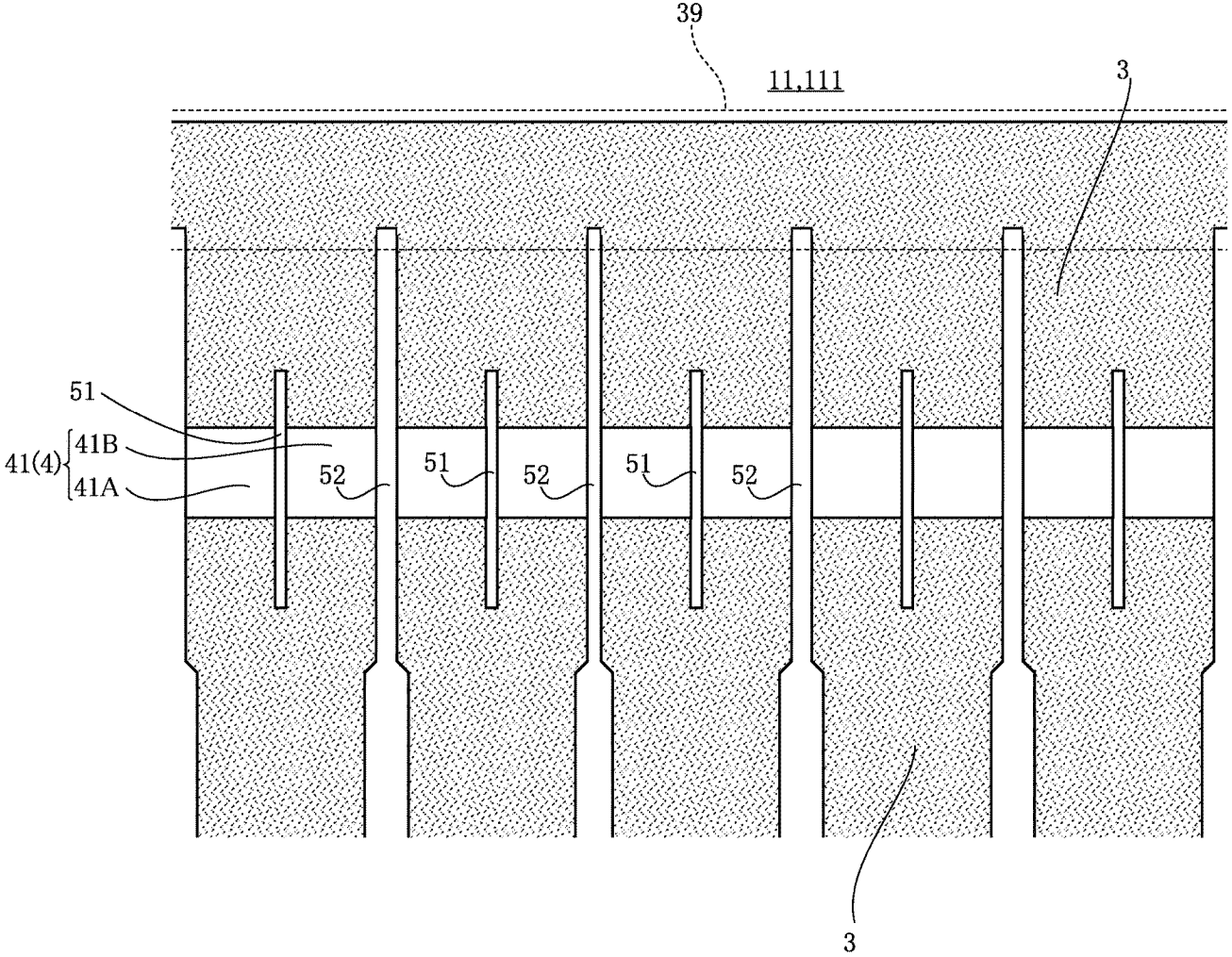
FIG. 19 is a plan view showing a state obtained upon performing the process of FIG. 18.

Proceeding to FIG. 18 and FIG. 19, a part of the electrode layer 3" is etched, so as to form the electrode layer 3. Through this process, the portions of the electrode layer 3" overlapping with the heating units 41 are collectively etched, so that the heating units 41 are exposed from the electrode layer 3.

The etching over the electrode layer and the resistor layer may be performed, for example, through forming a non-illustrated resist layer on the electrode layer, and exposing the resist layer.

Figure 20:
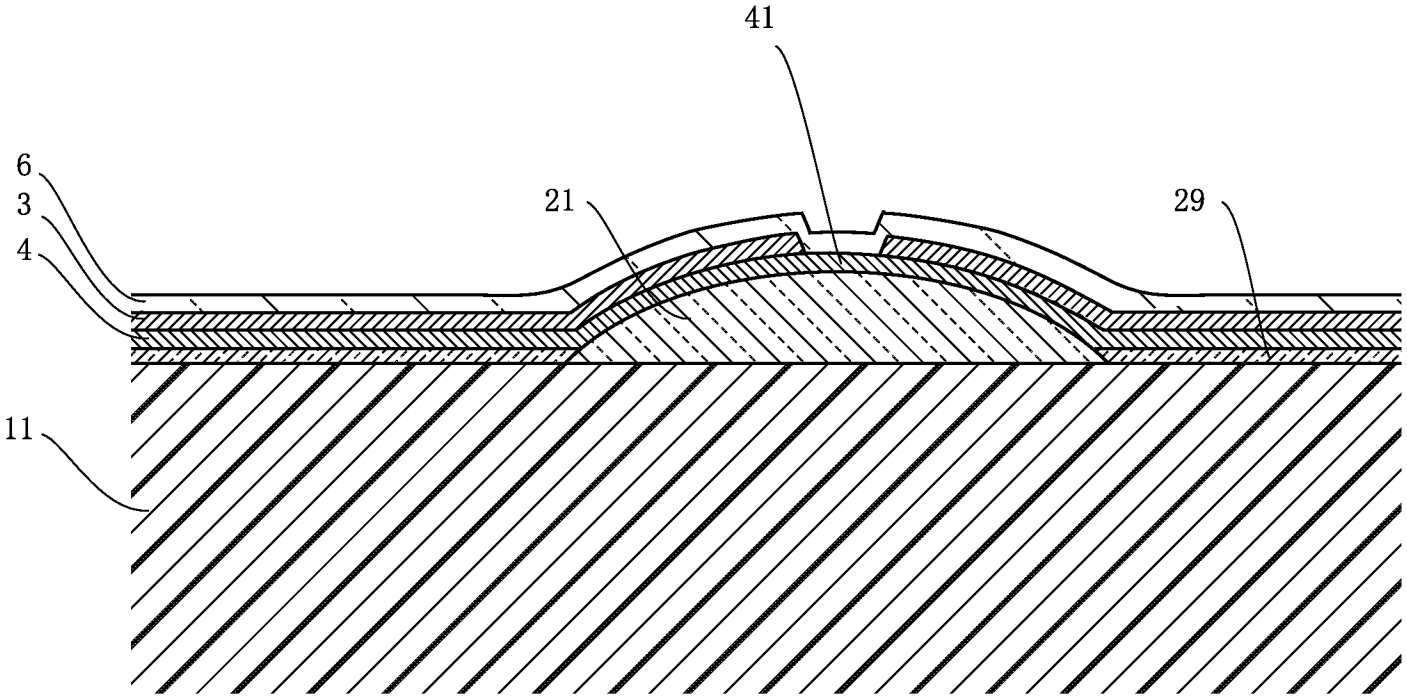
FIG. 20 is a cross-sectional view for explaining a manufacturing process that follows the process of FIG. 18.

Proceeding further to FIG. 20, the protection layer 6 is formed. The protection layer 6 may be formed through forming a mask for exposing desired regions, and depositing $SiO_2$ by sputtering or CVD.

Figure 21:
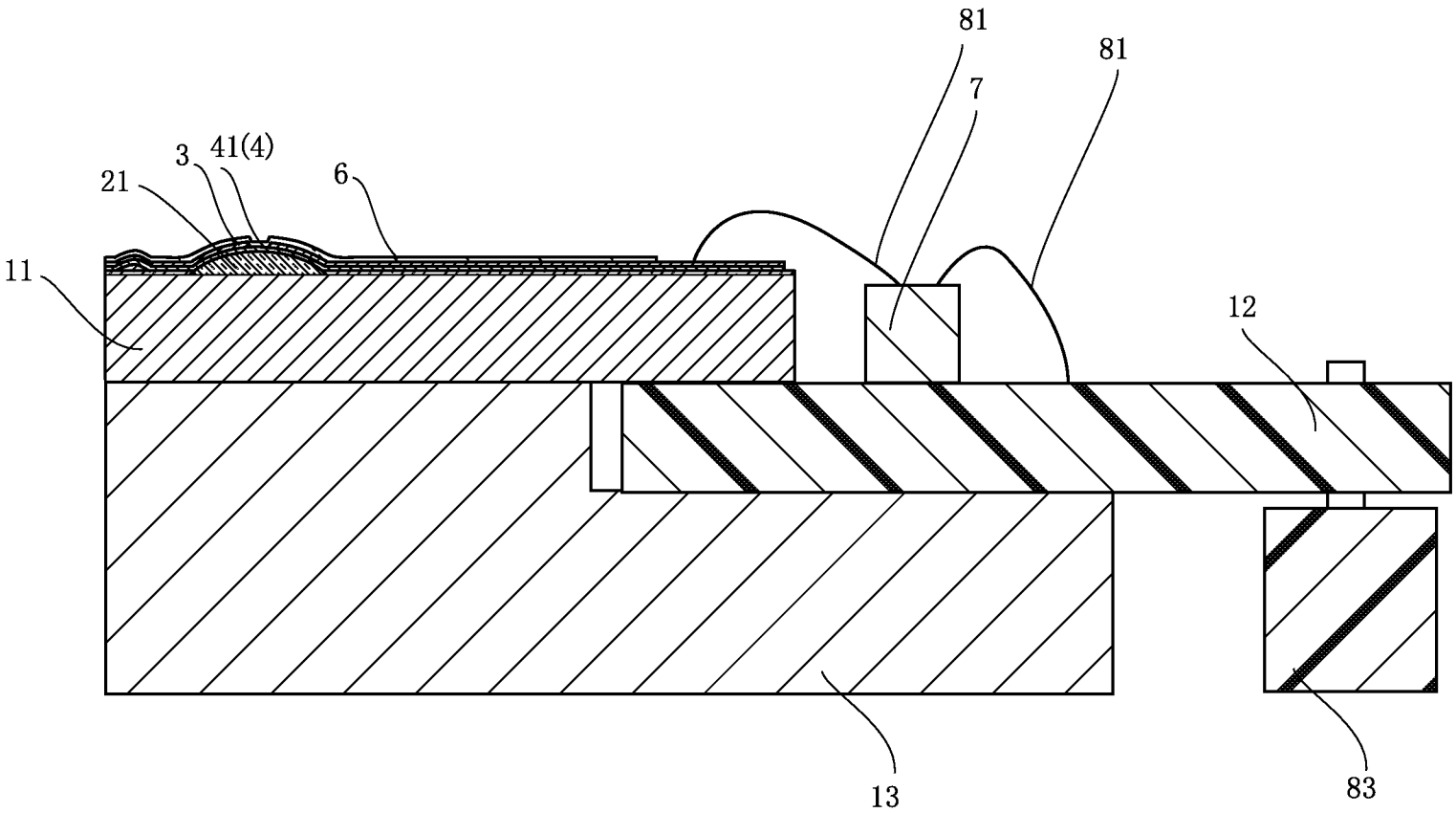
FIG. 21 is a cross-sectional view for explaining a manufacturing process that follows the process of FIG. 20.

After cutting the base member 11 (not shown), the base member 11 and the wiring board 12 with the connector 83 attached thereto are bonded to the heat dissipation plate 13, as shown in FIG. 21. Then the driver IC7 is mounted on the wiring board 12, and the wires 81 are bonded to the driver IC7. Thereafter, the wires 81 and the driver IC7 are covered with the resin portion (see FIG. 1). Through the foregoing process, the thermal print head 100 can be obtained.

The advantageous effects of this embodiment will be described below.

In conventional thermal print heads, the temperature of the heating unit is highest at a generally central portion. In this embodiment, in contrast, the heating units 41 each include the first heating element 41A and the second heating element 41B spaced apart from each other. The first heating element 41A is electrically connected to the common electrode 31 and one of the individual electrodes 32. The second heating element 41B is electrically connected to the common electrode 31 and the one of the individual electrodes 32 that is electrically connected to the first heating element 41A. Accordingly, the portion of the heating units 41 where the temperature becomes highest can be distributed to a generally central portion of the first heating element 41A and a generally central portion of the second heating element 41B. Therefore, the heat can be more efficiently transmitted to the position where a gap would be created on the printing medium 801 with the conventional thermal print head. The foregoing configuration consequently prevents the appearance of the gap between the dots printed on the printing medium 801 by the heating units 41 located adjacent to each other, thereby making characters and images printed on the printing medium 801 clearer.

In this embodiment, the first heating element 41A and the second heating element 41B are electrically connected in parallel. Accordingly, even when, for example, the resistance of the first heating element 41A increases to an unintended level, the voltage to be applied to the second heating element 41B is not affected by such an increase in resistance of the first heating element 41A. Therefore, even when the resistance of the first heating element 41A increases to an unintended level, the heat generation efficiency of the second heating element 41B is exempted from being degraded. Likewise, even when the resistance of the second heating element 41B increases to an unintended level, the voltage to be applied to the first heating element 41A is not affected by such an increase in resistance of the second heating element 41B. Therefore, even when the resistance of the second heating element 41B increases to an unintended level, the heat generation efficiency of the first heating element 41A is exempted from being degraded. With the thermal print head 100, therefore, visual degradation of the characters and images printed on the printing medium 801 can be suppressed, even when the resistance of one of the first heating element 41A and the second heating element 41B increases to an unintended level.

In this embodiment, the individual electrodes 32 are aligned in the main scanning direction Y and arranged adjacent to each other. In other words, the common electrode 31 is not provided between the individual electrodes 32. Such an arrangement facilitates the density of the individual electrodes in plan to be increased. Therefore, the individual electrodes 32 can be formed with an increased width, which prevents degradation in wiring resistance of the individual electrodes 32.

In this embodiment, the first groove 51 is formed so as to penetrate through a part of the electrode layer 3. Such a configuration assures that the first heating element 41A and the second heating element 41B are separated by the first groove 51, even though the etched region of the electrode layer 3' unduly shifts in the sub scanning direction X during the etching process of the electrode layer 3' described referring to FIG. 18 and FIG. 19. Therefore, the first heating element 41A and the second heating element 41B can be prevented from being connected to each other at a position not covered with the electrode layer 3, and consequently formation of the heating unit 41 having a different resistance from the desired value can be prevented.

In this embodiment, the protruding portions 311 each include the base portion 311R, the first joint portion 311A, and the second joint portion 311B. The base portion 311R extends from the strip-shaped portion 310. The first joint portion 311A and the second joint portion 311B are branched from the base portion 311R. The first joint portion 311A is in contact with the first heating element 41A, and the second joint portion 311B is in contact with the second heating element 41B. Such a configuration allows the protruding portion 311 to be formed with a larger area in plan, thereby suppressing an increase in resistance of the protruding portion 311.

In this embodiment, the individual electrodes 32 each include the base portion 321R, the first joint portion 321A, and the second joint portion 321B. The first joint portion 321A and the second joint portion 321B are branched from the base portion 321R. The first joint portion 321A is in contact with the first heating element 41A, and the second joint portion 321B is in contact with the second heating element 41B. Such a configuration allows the joint portion 321 to be formed with a larger area in plan, thereby suppressing an increase in resistance of the joint portion 321.

In this embodiment, further, the majority of the portions of the resistor layer 4 and the electrode layer 3 where the line width is narrow is only located in the vicinity of the heating unit 41, namely the first joint portion 311A, the second joint portion 311B, the first joint portion 321A, the second joint portion 321B, the first heating element 41A, and the second heating element 41B. In the portions other than the vicinity of the heating unit 41, the resistor layer 4 and the electrode layer 3 can be formed with a sufficient width. Such a configuration contributes to improving the production yield of the thermal print head 100.

First Variation of First Embodiment

Figure 22:
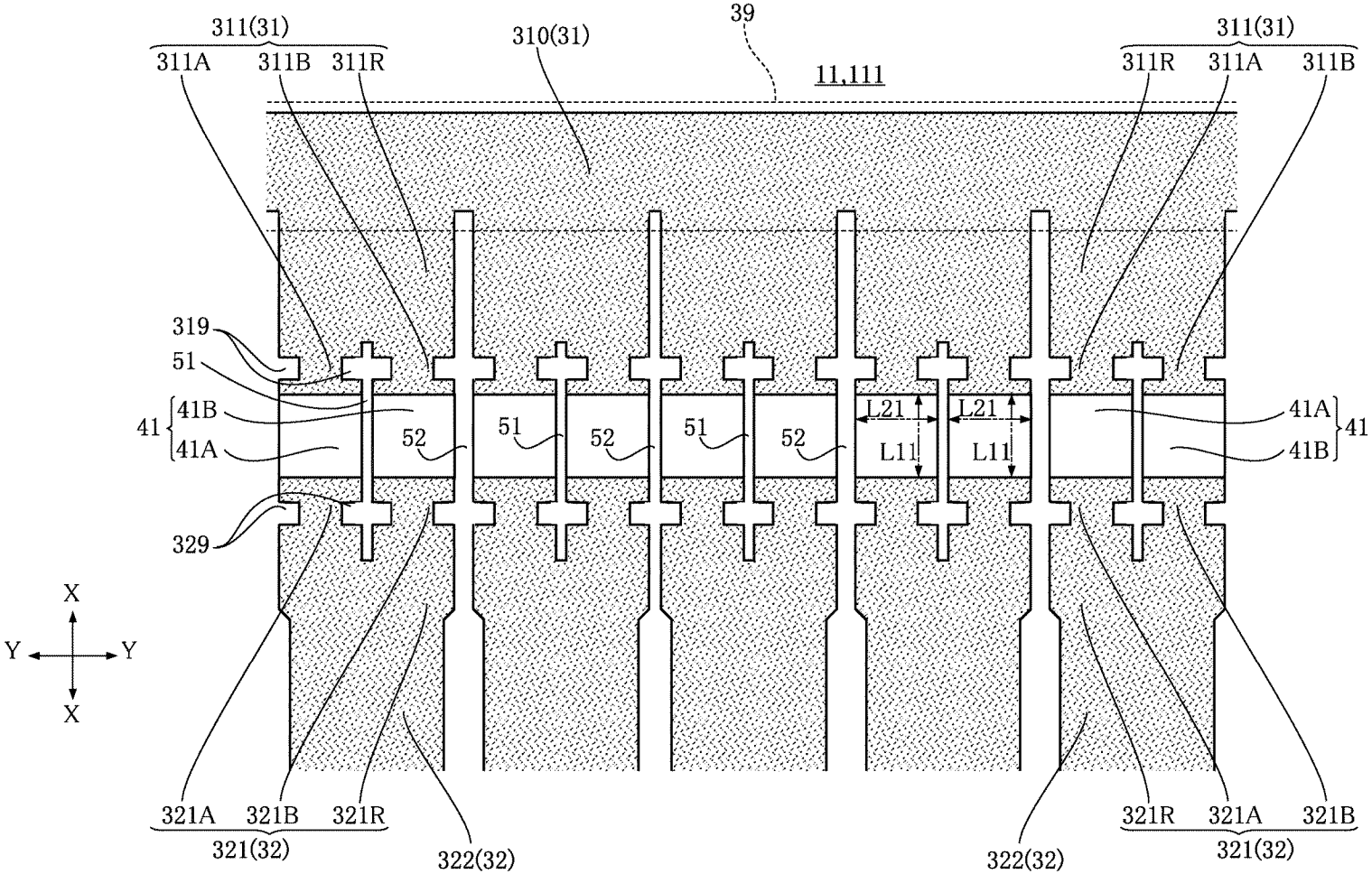
FIG. 22 is an enlarged fragmentary plan view of a thermal print head according to a first variation of the first embodiment of the present invention, with a part omitted.

Referring now to FIG. 22, a first variation of the first embodiment of the present invention will be described.

In the description given below, the elements same as or similar to those referred to above will be given the same numeral, and the description thereof will not be repeated.

FIG. 22 is an enlarged fragmentary plan view of a thermal print head according to the first variation of the first embodiment of the present invention, with a part omitted.

This variation is different from the thermal print head 100 in that the electrode layer 3 includes a constricted portion 319 and a constricted portion 329.

The constricted portion 319 is formed in the common electrode 31, and more specifically in each of the protruding portions 311. More precisely, the constricted portion 319 is formed in the first joint portion 311A and the second joint portion 311B. Accordingly, the first joint portion 311A and the second joint portion 311B each include a partially narrowed portion.

The constricted portion 329 is formed in each of the individual electrodes 32, and more specifically in each of the joint portions 321. More precisely, the constricted portion 329 is formed in the first joint portion 321A and the second joint portion 321B. Accordingly, the first joint portion 321A and the second joint portion 321B each include a partially narrowed portion.

The foregoing configuration restricts the heat generated in the first heating element 41A and the second heating element 41B from escaping in the sub scanning direction X. As a result, a larger part of the heat generated in the first heating element 41A and the second heating element 41B can be utilized for the printing on the printing medium 801.

Second Embodiment

Figure 23:
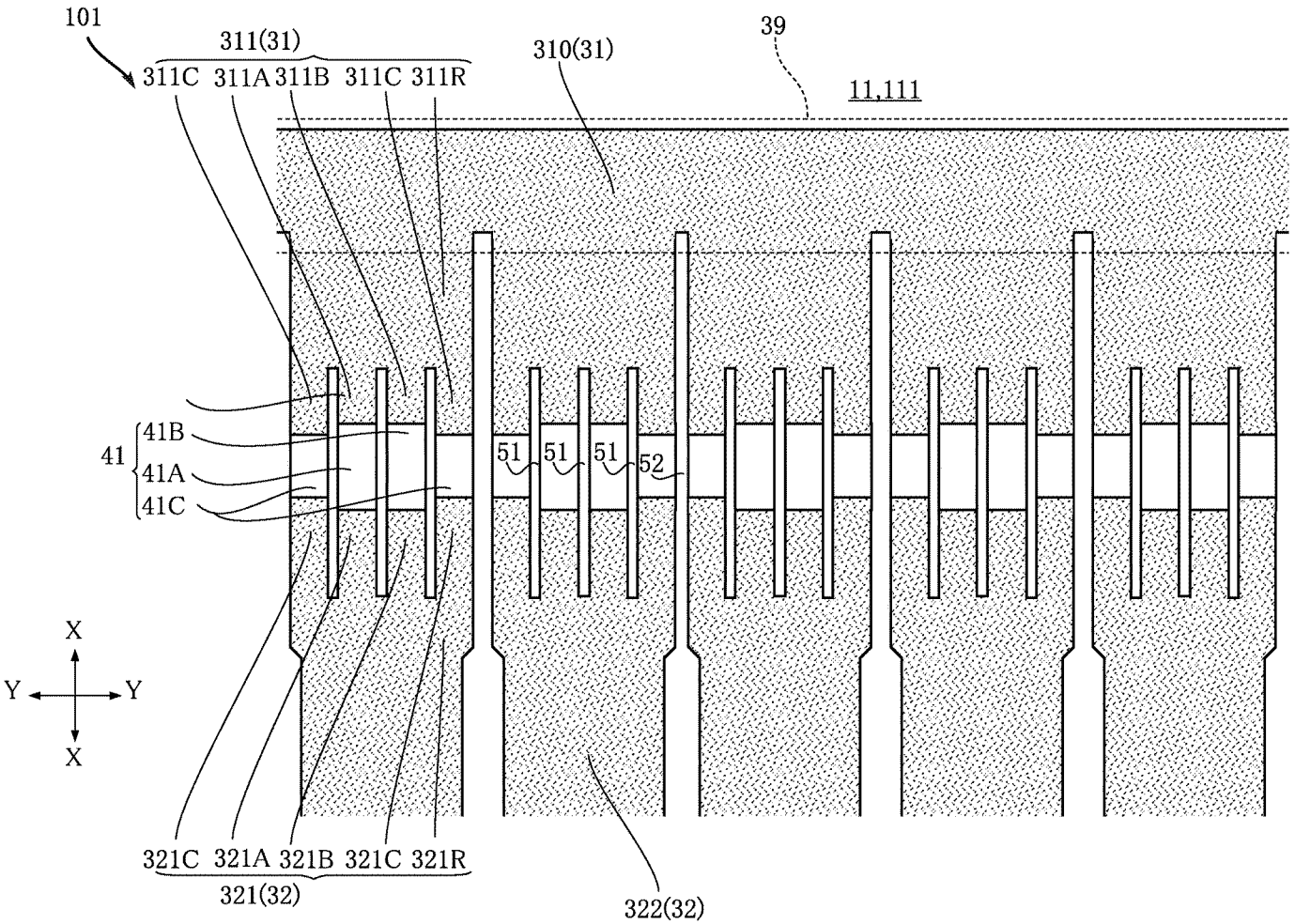
FIG. 23 is an enlarged fragmentary plan view of a thermal print head according to a second embodiment of the present invention, with a part omitted.

Referring to FIG. 23, a second embodiment of the present invention will be described below.

FIG. 23 is an enlarged fragmentary plan view of a thermal print head according to a second embodiment of the present invention, with a part omitted.

A thermal print head 101 shown in FIG. 23 includes the base member 11, the wiring board 12, the heat dissipation plate 13, the heat storage region 21, the electrode layer 3, the resistor layer 4, the protection layer 6, the driver IC7, the wires 81, the resin portion 82, and the connector 83. The thermal print head 101 is different from the thermal print head 100 in the configuration of the electrode layer 3 and the resistor layer 4. Except for the electrode layer 3 and the resistor layer 4, the base member 11, the wiring board 12, the heat dissipation plate 13, the heat storage region 21, the protection layer 6, the driver IC7, the wires 81, the resin portion 82, and the connector 83 of the thermal print head 101 have the same configuration as those of the thermal print head 100, and therefore the description of those elements will not be repeated.

The resistor layer 4 according to this embodiment is different from the resistor layer 4 in the thermal print head 100, in the following aspect.

A plurality of heating units 41 of the resistor layer 4 each include at least one additional heating element 41C, in addition to first heating element 41A and the second heating element 41B. The at least one additional heating element 41C is spaced apart from both of the first heating element 41A and the second heating element 41B in the main scanning direction Y. In this embodiment, two additional heating elements 41C are provided. In each of the heating units 41, the first heating element 41A and the second heating element 41B are disposed between the two additional heating elements 41C. The additional heating elements 41C are smaller in size in the sub scanning direction X than are the first heating element 41A and the second heating element 41B. Accordingly, the additional heating elements 41C have a lower resistance than that of the first heating element 41A and the second heating element 41B.

The electrode layer 3 according to this embodiment is different from the electrode layer 3 in the thermal print head 100, in the following three aspects.

The protruding portions 311 of the common electrode 31 each include at least one additional joint portion 311C, in addition to the base portion 311R, the first joint portion 311A, and the second joint portion 311B. In this embodiment, two additional joint portions 311C are provided. The additional joint portions 311C are in contact with the respective additional heating elements 41C.

The joint portions 321 of the individual electrode 32 each include at least one additional joint portion 321C, in addition to the base portion 321R, the first joint portion 321A, and the second joint portion 321B. In this embodiment, two additional joint portions 321C are provided. The additional joint portions 321C are in contact with the respective additional heating elements 41C.

Alternatively, the number of additional heating elements 41C, the additional joint portions 311C, and the additional joint portion 321C may be one, or three or more, unlike in this embodiment.

The advantageous effects of this embodiment will now be described.

This embodiment provides the following advantageous effects, in addition to those provided by the thermal print head 100.

In this embodiment, the resistance of the additional heating element 41C is lower than that of the first heating element 41A and that of the second heating element 41B. Such a configuration makes the calorific value per unit time of the additional heating element 41C greater than the calorific value per unit time of the first heating element 41A and that of the second heating element 41B, thereby allowing a larger amount of heat to be generated in the end portions of the heating unit 41 in the main scanning direction Y. Therefore, the appearance of a gap between the dots printed on the printing medium 801 by the heating units 41 located adjacent to each other can be more properly prevented. As a result, clearer characters and images can be produced on the printing medium 801.

The present invention is not limited to the foregoing embodiments. The specific configuration of the elements of the present invention may be modified in various ways.

The invention claimed is:

1. A thermal print head comprising:

a base member;

an electrode layer formed on the base member; and a resistor layer formed on the base member, wherein the electrode layer includes a common electrode and individual electrodes, the resistor layer includes heating units aligned in a main scanning direction, each of the heating units includes a first heating element and a second heating element spaced apart from each other, the first heating element is electrically connected to the common electrode and one of the individual electrodes, the second heating element is electrically connected to the common electrode and the one of the individual electrodes that is electrically connected to the first heating element, the common electrode and the one of the individual electrodes that is electrically connected to the first heating element are spaced apart from each other in a sub scanning direction by a first distance with the first heating element disposed therebetween, the first and second heating elements include first and second edges, respectively, the first edge of the first heating element and the second edge of the second heating element are spaced apart from each other in the main scanning direction by a second distance, and the one of the individual electrodes that is electrically connected to the first heating element includes a portion that has a size in the main scanning direction that is smaller than the second distance over a length in the sub scanning direction that is larger than the first distance.

2. The thermal print head according to claim 1, wherein the first heating element and the second heating element are electrically connected in parallel.

3. The thermal print head according to claim 1, wherein the individual electrodes are aligned in the main scanning direction and arranged adjacent to one another.

4. The thermal print head according to claim 1, wherein a first groove is formed between the first heating element and the second heating element, the first groove penetrating through the resistor layer.

5. The thermal print head according to claim 4, wherein the first groove penetrates through a part of the electrode layer.

6. The thermal print head according to claim 4, wherein the first groove penetrates through the common electrode and the one individual electrode.

7. The thermal print head according to claim 6, wherein a portion of the first groove penetrating through the common electrode has a size of 5 to 30 μm in the sub scanning direction.

8. The thermal print head according to claim 6, wherein a portion of the first groove penetrating through the one individual electrode has a size of 5 to 30 μm in the sub scanning direction.

9. The thermal print head according to claim 4, wherein the first groove extends in the sub scanning direction.

10. The thermal print head according to claim 9, wherein the first groove is greater in length in the sub scanning direction than the first heating element.

11. The thermal print head according to claim 4, wherein a second groove is formed between two adjacent ones of the heating units, the second groove penetrating through the resistor layer.

12. The thermal print head according to claim 11, wherein the second groove penetrates through a part of the electrode layer.

13. The thermal print head according to claim 11, wherein the second groove is greater in size in the sub scanning direction than the first groove.

14. The thermal print head according to claim 11, wherein the second groove includes a narrowed portion and a widened portion, the narrowed portion is smaller in width in the main scanning direction than the widened portion, and the narrowed portion overlaps with an entirety of the first groove in the sub scanning direction.

15. The thermal print head according to claim 1, wherein the common electrode includes a common electrode strip-shaped portion extending in the main scanning direction, and the individual electrodes are opposed to the common electrode strip-shaped portion in the sub scanning direction with respect to the heating units.

16. The thermal print head according to claim 15, wherein the common electrode includes protruding portions each extending from the common electrode strip-shaped portion, and each of the protruding portions is in contact with one of the heating units.

17. The thermal print head according to claim 16, wherein each of the protruding portions includes a common electrode base portion, a first common electrode joint portion, and a second common electrode joint portion, the common electrode base portion is connected to the common electrode strip-shaped portion, the first common electrode joint portion and the second common electrode joint portion are branched from the common electrode base portion, the first common electrode joint portion is in contact with the first heating element, and the second common electrode joint portion is in contact with the second heating element.

18. The thermal print head according to claim 16, wherein each of the protruding portions each includes a constricted portion.

19. The thermal print head according to claim 1, wherein each of the individual electrodes includes an individual electrode base portion, a first individual electrode joint portion, and a second individual electrode joint portion, the first individual electrode joint portion and the second individual electrode joint portion are branched from the individual electrode base portion, the first individual electrode joint portion is in contact with the first heating element, and the second individual electrode joint portion is in contact with the second heating element.

20. The thermal print head according to claim 19, wherein each of the individual electrodes includes a constricted portion.

21. The thermal print head according to claim 1, wherein the resistor layer is disposed between the base member and the electrode layer.

22. The thermal print head according to claim 1, wherein a size of the first heating element in the main scanning direction is smaller than the first distance.

23. The thermal print head according to claim 22, wherein the first distance is 60 to 100 μm, and the size of the first heating element in the main scanning direction is 40 to 60 μm.

24. The thermal print head according to claim 1, wherein each of the heating units includes at least one additional heating element, the at least one additional heating element is spaced apart from both of the first heating element and the second heating element in the main scanning direction, and the at least one additional heating element is smaller in resistance than each of the first heating element and the second heating element.

25. The thermal print head according to claim 1, further comprising a heat storage region disposed between the base member and the heating units.

26. The thermal print head according to claim 25, wherein the heat storage region is made of a glass material.

27. The thermal print head according to claim 1, further comprising an auxiliary conductive layer overlapping with the common electrode in plan, wherein the auxiliary conductive layer is disposed between the electrode layer and the base member.

28. The thermal print head according to claim 27, wherein the auxiliary conductive layer is made of Ag.

29. The thermal print head according to claim 27, wherein the auxiliary conductive layer has a thickness of 10 to 30 μm.

30. The thermal print head according to claim 1, further comprising a driver IC for supplying a current to the electrode layer.

31. The thermal print head according to claim 30, further comprising a wire connecting the driver IC and the electrode layer.

32. The thermal print head according to claim 30, further comprising a resin portion covering the driver IC.

33. The thermal print head according to claim 30, further comprising a wiring board on which the driver IC is mounted.

34. The thermal print head according to claim 1, further comprising an insulative protection layer covering the resistor layer and the electrode layer.

35. The thermal print head according to claim 1, wherein the base member is made of a ceramic material.

36. The thermal print head according to claim 1, wherein the electrode layer is made of Al.

37. The thermal print head according to claim 1, wherein the electrode layer is formed by sputtering.

38. The thermal print head according to claim 1, wherein the resistor layer is made of $TaSiO_2$ or TaN.

39. The thermal print head according to claim 1, wherein the resistor layer has a thickness of 0.05 to 0.2 μm.

40. The thermal print head according to claim 1, wherein the resistor layer is formed by sputtering.

41. The thermal print head according to claim 1, further comprising a heat dissipation plate supporting the base member.

42. A thermal printer comprising:

a thermal print head according to claim 1; and a platen roller opposed to the thermal print head.

* * * * *